US008591387B2

(12) United States Patent
Fife

(10) Patent No.: US 8,591,387 B2
(45) Date of Patent: Nov. 26, 2013

(54) MULTI-GRIP DUMBBELL

(75) Inventor: Andrew P. Fife, Seattle, WA (US)

(73) Assignees: Christopher Leier, Lake Tapps, WA (US); Ann Rylie Leier, Lake Tapps, WA (US)

( * ) Notice: Subject to any disclaimer, the term of this patent is extended or adjusted under 35 U.S.C. 154(b) by 1521 days.

(21) Appl. No.: 11/827,419

(22) Filed: Jul. 11, 2007

(65) Prior Publication Data

US 2008/0108483 A1 May 8, 2008

Related U.S. Application Data

(60) Provisional application No. 60/857,717, filed on Nov. 7, 2006.

(51) Int. Cl.
*A63B 21/072* (2006.01)
*A63B 21/06* (2006.01)

(52) U.S. Cl.
USPC ..... 482/108; 482/106; 482/93

(58) Field of Classification Search
USPC ..... 482/106–108
See application file for complete search history.

(56) References Cited

U.S. PATENT DOCUMENTS 4,029,312 A * 6/1977 Wright ..... 482/108
5,024,434 A * 6/1991 Smith ..... 482/107
5,334,113 A * 8/1994 Roepke ..... 482/106

* cited by examiner

*Primary Examiner* — LoAn H. Thanh
*Assistant Examiner* — Shila Jalalzadeh Abyane
(74) *Attorney, Agent, or Firm* — Olympic Patent Works PLLC

(57) ABSTRACT

Various embodiments of the present invention are directed to a multi-grip dumbbell. In one embodiment of the present invention, a multi-grip dumbbell includes a central handle, a first weighted head interconnected to the central handle in proximity to a first end of the central handle, and a second weighted head interconnected to the central handle in proximity to a second end of the central handle. The first weighted head is approximately evenly weighted with the second weighted head. The first weighted head includes a first weighted end handle and two weighted side handles. Similarly, the second weighted head includes a second weighted end handle and two weighted side handles.

19 Claims, 25 Drawing Sheets

MULTI-GRIP DUMBBELL

CROSS-REFERENCE TO RELATED APPLICATION

This application claims the benefit of Provisional Application No. 60/857,717, filed Nov. 7, 2006.

TECHNICAL FIELD

The present invention relates to the field of exercise equipment, and, in particular, to a multi-grip dumbbell.

BACKGROUND OF THE INVENTION

Athletes, exercisers, and physical-therapy patients ("users") often use exercise equipment to increase muscle mass, increase cardiovascular fitness, and/or aid with muscle rehabilitation. Many users prefer to use free weights because a large variety of exercises may be performed using free weights and because free weights may be less expensive and need less storage and usage space than other types of exercise equipment. Additionally, free-weight exercises allow a user to move weights without restrictive poles, weight-and-pulley systems, and other types of guidance systems commonly used by exercise equipment. Accordingly, in addition to promoting power, strength, and athletic performance, free-weight use may also promote balance, and posture by developing stabilizing muscles.

Three commonly-used types of free weights are dumbbells, barbells, and kettlebells. Dumbbells are typically one-handed free weights. Accordingly, exercises performed with dumbbells are generally performed by either gripping a single dumbbell with one hand, or gripping a pair of dumbbells with two hands. Dumbbells may be adjustable or fixed-weight. FIG. 1A shows two exemplary adjustable dumbbells. In FIG. 1A, two adjustable dumbbells 100 and 101 are shown. The adjustable dumbbell 100 includes a central handle 102 for gripping the adjustable dumbbell 100, a first removably-attached grouping of variably-sized weight plates 104 in proximity to a first end of the central handle 102, and a second removably-attached grouping of variably-sized weight plates 106 in proximity to a second end of the central handle 102. Typically, the first removably-attached grouping of variably-sized weight plates 104 and the second removably-attached grouping of variably-sized weight plates 106 are of approximately equal weight and the length of a gripping surface on the central handle 102 is typically not much longer than the width of a user's hand. FIG. 1B shows an exemplary fixed-weight dumbbell. A fixed-weight dumbbell 108 includes a relatively short central handle, or core 110, for gripping the fixed-weight dumbbell 108 and permanently-attached weight knobs 112 and 114 at the opposite ends of the core 110.

A user may focus exercises, using either an adjustable or a fixed-weight dumbbell ("dumbbell"), on specific areas of the user's body. FIG. 2 shows a series of exemplary exercises performed using one or more dumbbells. Examples of different exercises that may be performed using a dumbbell include: (1) a flat bench dumbbell press 202; (2) a flat bench dumbbell fly 203; (3) an incline dumbbell press 204; (4) a single arm dumbbell row 205; (5) a shrug 216; (6) a seated dumbbell press 207; (7) a side lateral raise 208; (8) a seated alternate dumbbell bicep curl 209; and (9) a bicep concentration curl 210. In each of the exercises 202-210, each dumbbell is gripped by a central handle, which is maintained approximately in a horizontal orientation.

A user's grip around a central handle with a gripping surface not much longer than the width of a user's hand limits the number of available hand-gripping positions. Exercises performed using dumbbells are typically performed either using relatively low-weight dumbbells and/or maintaining dumbbells in a position such that a central handle is approximately in a horizontal orientation so as to maintain a user's wrist in a relatively straight orientation to reduce potential strain and injury. FIG. 3 shows a series of exercises performed using dumbbells involving potentially unsafe wrist twisting. FIG. 3 shows a user 302 performing a tricep dumbbell press 304 and a tricep kickout 306. When performing the tricep dumbbell press 304 or the tricep kickout 306, the user 302 may twist his or her wrist. Twisting of a wrist may lead to strain and injury. In addition, because a user typically grips a dumbbell around a relatively short central handle, group exercises, which involve passing a dumbbell between two or more users, and single-user exercises in which a user grips a dumbbell with two hands, may be difficult to perform. Furthermore, due to a limited number of available hand positions, exercises utilizing movements which employ several different hand positions, such as dynamic exercises, may be difficult to perform using a dumbbell.

Barbells are typically two-handed free weights. Exercises performed with barbells are generally performed by a user gripping a single barbell with two hands. FIG. 4 shows an exemplary barbell. A barbell 400 includes a central handle 402 for gripping the barbell 400 with two variably-spaced hands, a first group of variably-sized weight plates 404 in proximity to a first end of the central handle 402, and a second group of variably-sized weight plates in proximity to a second end of the central handle 402. As with dumbbells, the first group of variably-sized weight plates 404 and the second group of variably-sized weight plates 406 are typically of approximately equal weight.

FIG. 5 shows a series of exemplary exercises performed using barbells. Some exercises that may be performed using a barbell include: (1) a bench press 502; and (2) a barbell squat 504. Barbells are often heavier than dumbbells and, due to the relatively-long length of the central handle of a barbell, may be less stable and may create more torque while lifting. Consequently, barbell users often utilize a spotter to help avoid injury in the event that the barbell user is unable to maintain control of the barbell. The relatively-long length of a central handle for a barbell allows for more hand positions than a dumbbell. Therefore, dynamic exercises may be performed with barbells. However, the relatively-long length of a central handle for a barbell may make it difficult for a user to perform exercises involving horizontal twisting of the central handle, or exercises where the central handle of the barbell is positioned in an approximately perpendicular orientation. Additionally, the relatively-long length of a central handle may necessitate the use of a large amount of space for performing exercises.

Kettlebells are typically one-handed free weights. Kettlebell exercises are generally performed by either gripping a single kettlebell with one hand, or gripping a pair of kettlebells with two hands. FIG. 6 shows an exemplary kettlebell. A kettlebell 600 includes a ball with a flat bottom 602 attached to a curved handle 604 for gripping. The shape of a kettlebell creates a center of gravity low on a user's arm, enabling the user to safely perform exercises involving the twisting of the user's wrist, such as the wrist-twisting exercises shown in FIG. 3. Consequently, exercises performed with kettlebells may be dynamic, powerful, and explosive. FIG. 7 shows a series of exemplary exercises performed using one or more kettlebells. Some exemplary exercises that may be performed using one or more kettlebells include: (1) a kettlebell clean 702; (2) a single arm kettlebell row 704; (3) an alternating floor press 706; (4) a single arm kettlebell jerk 708; (5) a kettlebell swing 710; and (6) a kettlebell windmill 712. The ability to perform body motions that include wrist twisting allows a user to rapidly transition between a plurality of exercises, resulting in increased cardiovascular fitness and greater overall strength.

However, the configuration of a kettlebell often makes it difficult for a user to grip one kettlebell with two hands, limiting the gripping options available to the user. In addition, the orientation of a user's grip on a curved handle makes it potentially unsafe for a user to transfer a kettlebell to another user while performing group exercises. Kettlebells are also not readily available in a wide range of weights. Athletic trainers, coaches, physical therapists, and users have, therefore, recognized a need for compact free weights that allow a user to safely perform a large number of different exercises, including one-handed exercises, two-handed exercises, dynamic exercises involving wrist-twisting, and exercises involving the passing of exercise equipment between two or more users.

SUMMARY OF THE INVENTION

Various embodiments of the present invention are directed to a multi-grip dumbbell. In one embodiment of the present invention, a multi-grip dumbbell includes a central handle, a first weighted head interconnected to the central handle in proximity to a first end of the central handle, and a second weighted head interconnected to the central handle in proximity to a second end of the central handle. The first weighted head is approximately evenly weighted with the second weighted head. The first weighted head includes a first weighted end handle and two weighted side handles. Similarly, the second weighted head includes a second weighted end handle and two weighted side handles.

DETAILED DESCRIPTION OF THE INVENTION

Various embodiments of the present invention are directed to a multi-grip dumbbell. In one embodiment of the present invention, the multi-grip dumbbell includes a central handle and a weighted head in proximity to each of two ends of the central handle. Each weighted head includes a weighted end handle and two weighted side handles. A user may grip one or more of a number of different handles on one or more of the multi-grip dumbbells with either one or two hands. Once the user has a firm grip on one or more multi-grip dumbbells, the user may perform a variety of different exercises with the one or more multi-grip dumbbells, including one-handed exercises, two-handed exercises, dynamic exercises, passing exercises, and other types of exercises.

Figure 1A:
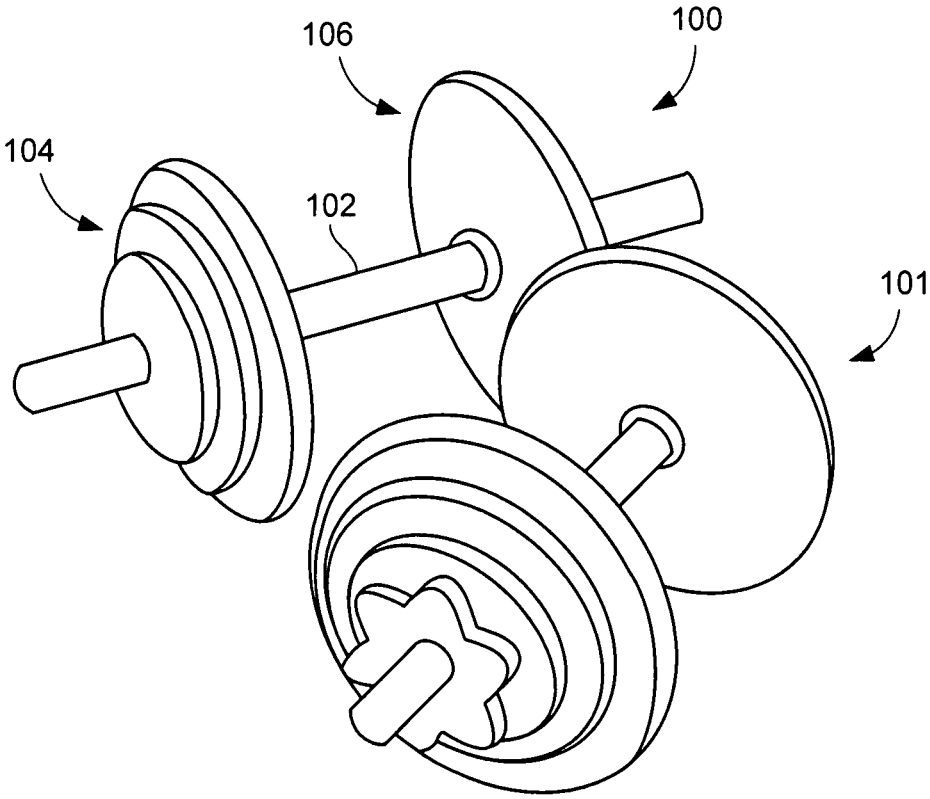
FIG. 1A shows two exemplary adjustable dumbbells.
Figure 1B:
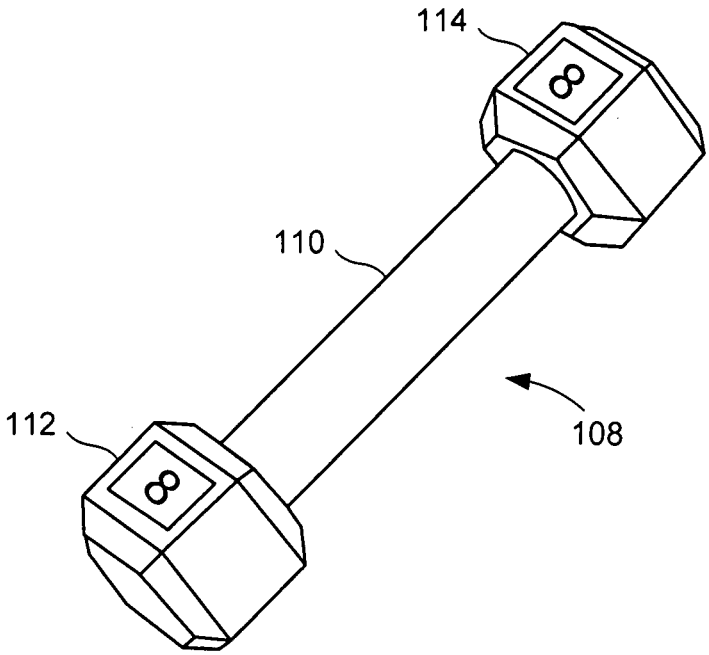
FIG. 1B shows an exemplary fixed-weight dumbbell.
Figure 2:
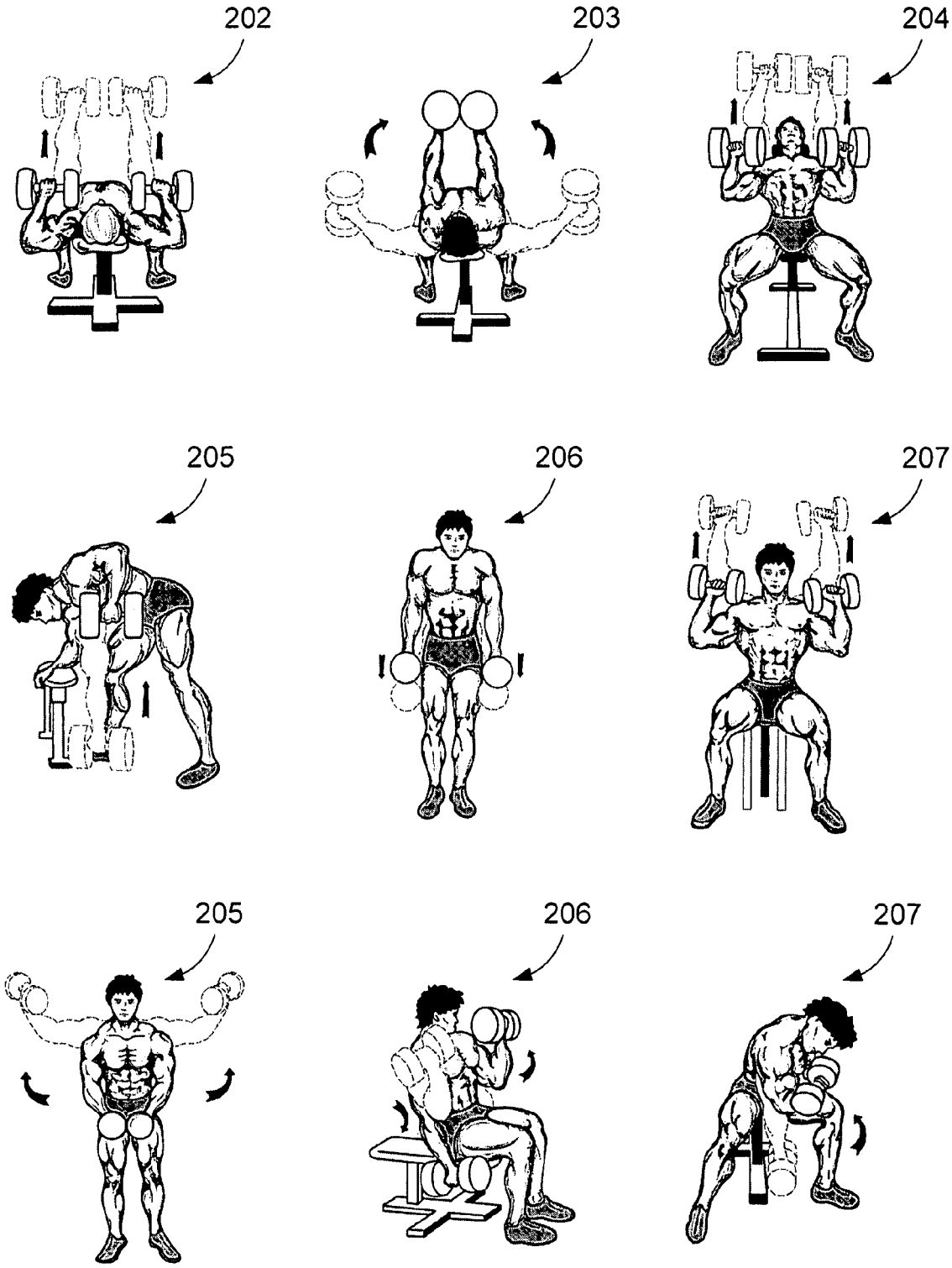
FIG. 2 shows a series of exemplary exercises performed using dumbbells.
Figure 3:
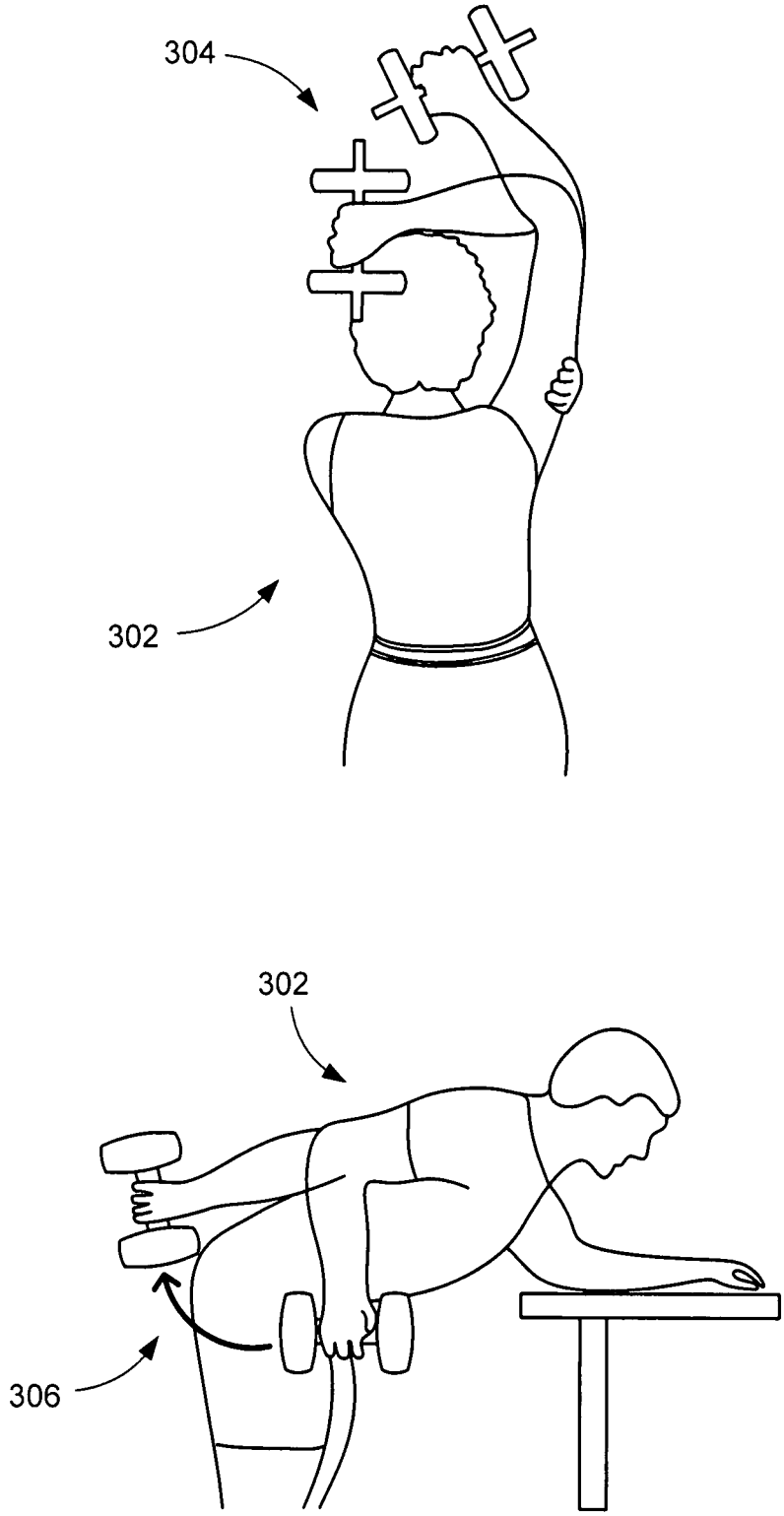
FIG. 3 shows a series of exercises performed using dumbbells involving potentially unsafe wrist-twisting.
Figure 4:
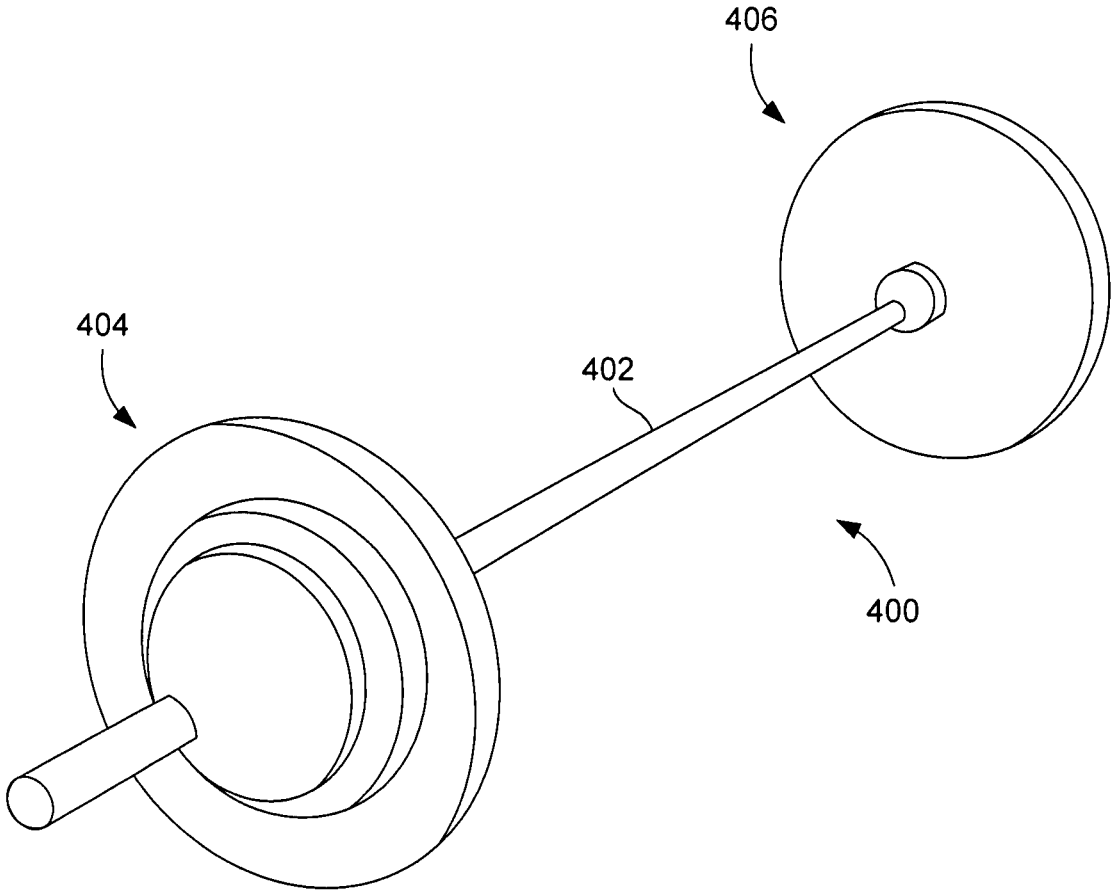
FIG. 4 shows an exemplary barbell.
Figure 5:
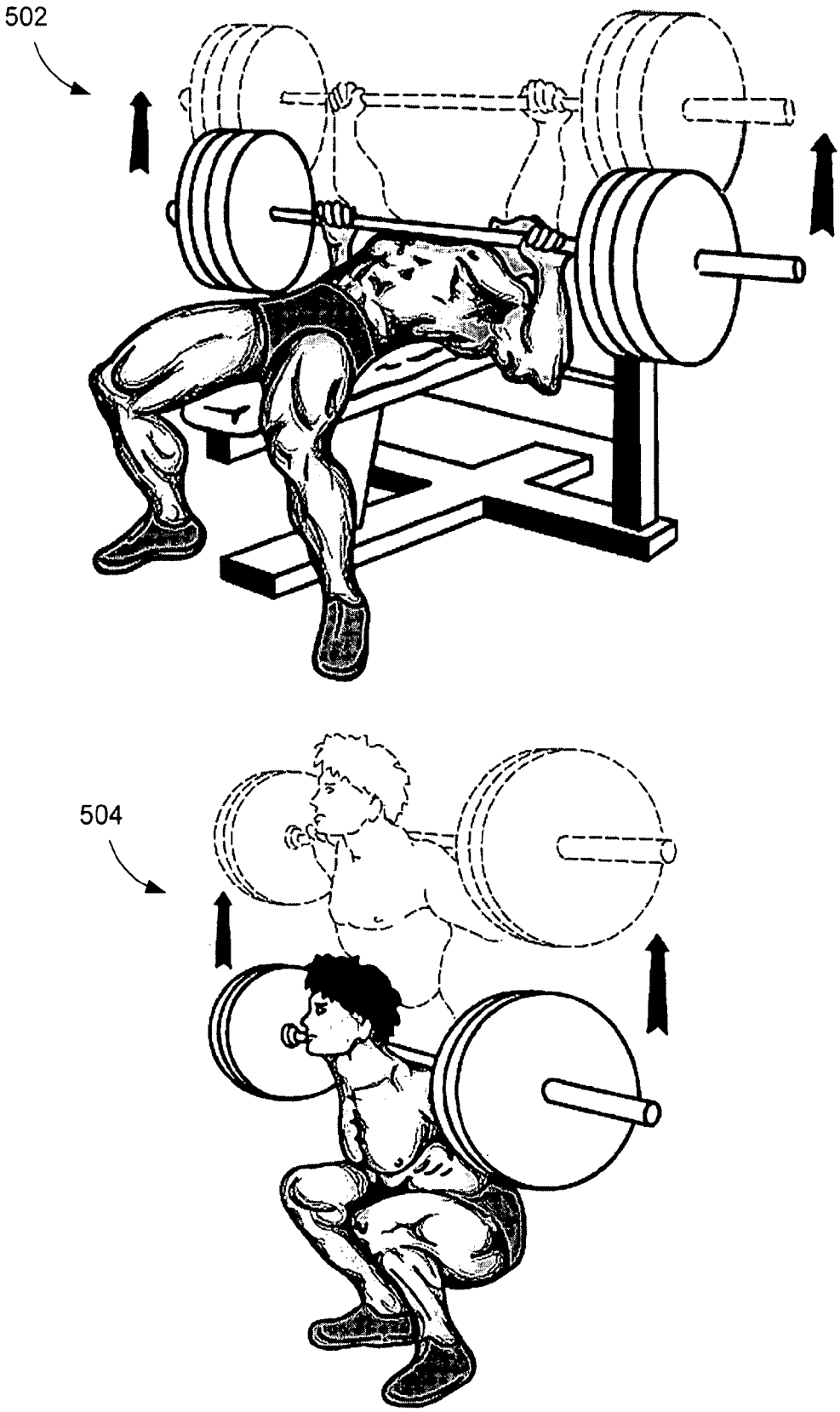
FIG. 5 shows a series of exemplary exercises performed using barbells.
Figure 6:
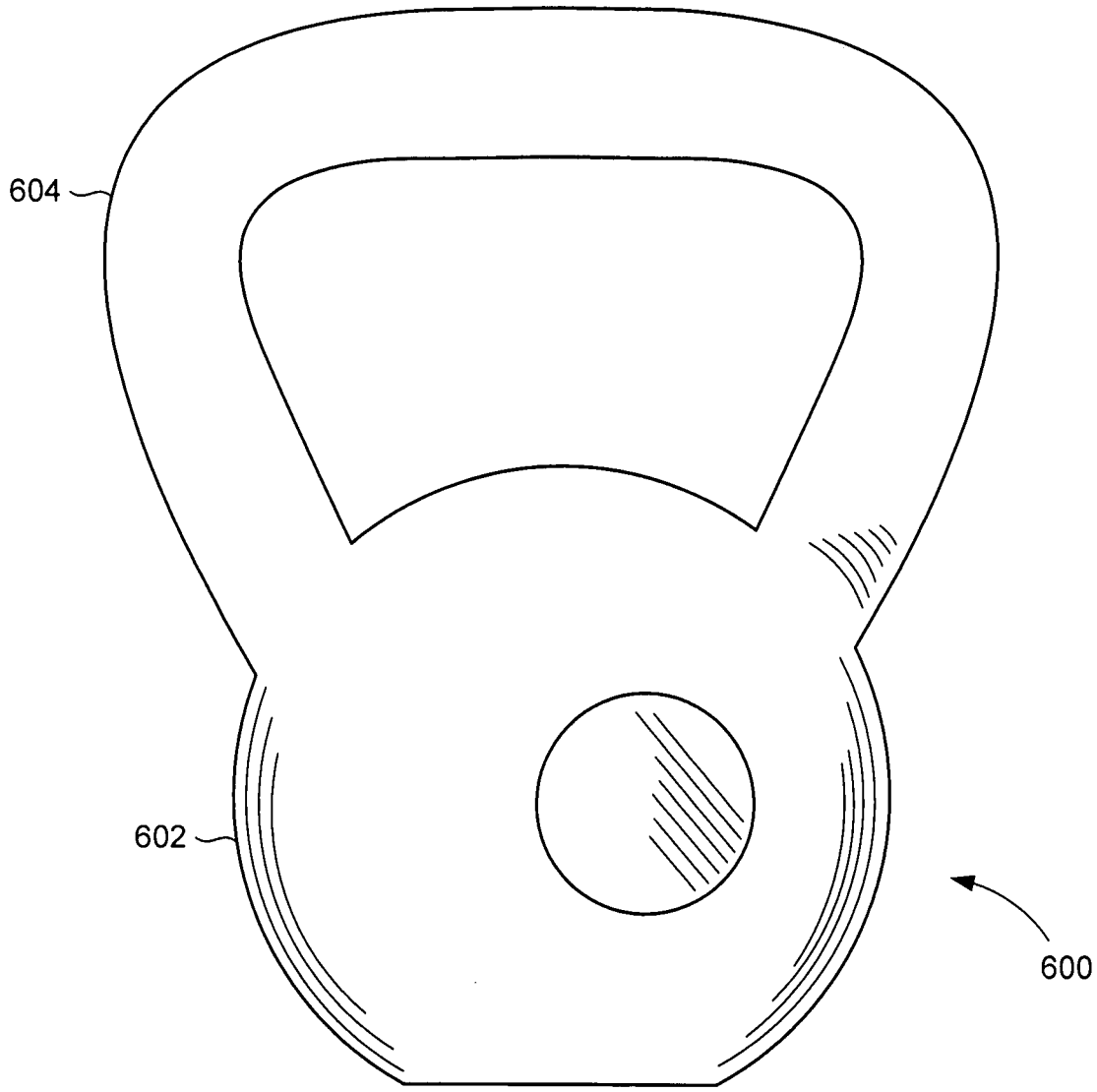
FIG. 6 shows an exemplary kettlebell.
Figure 7:
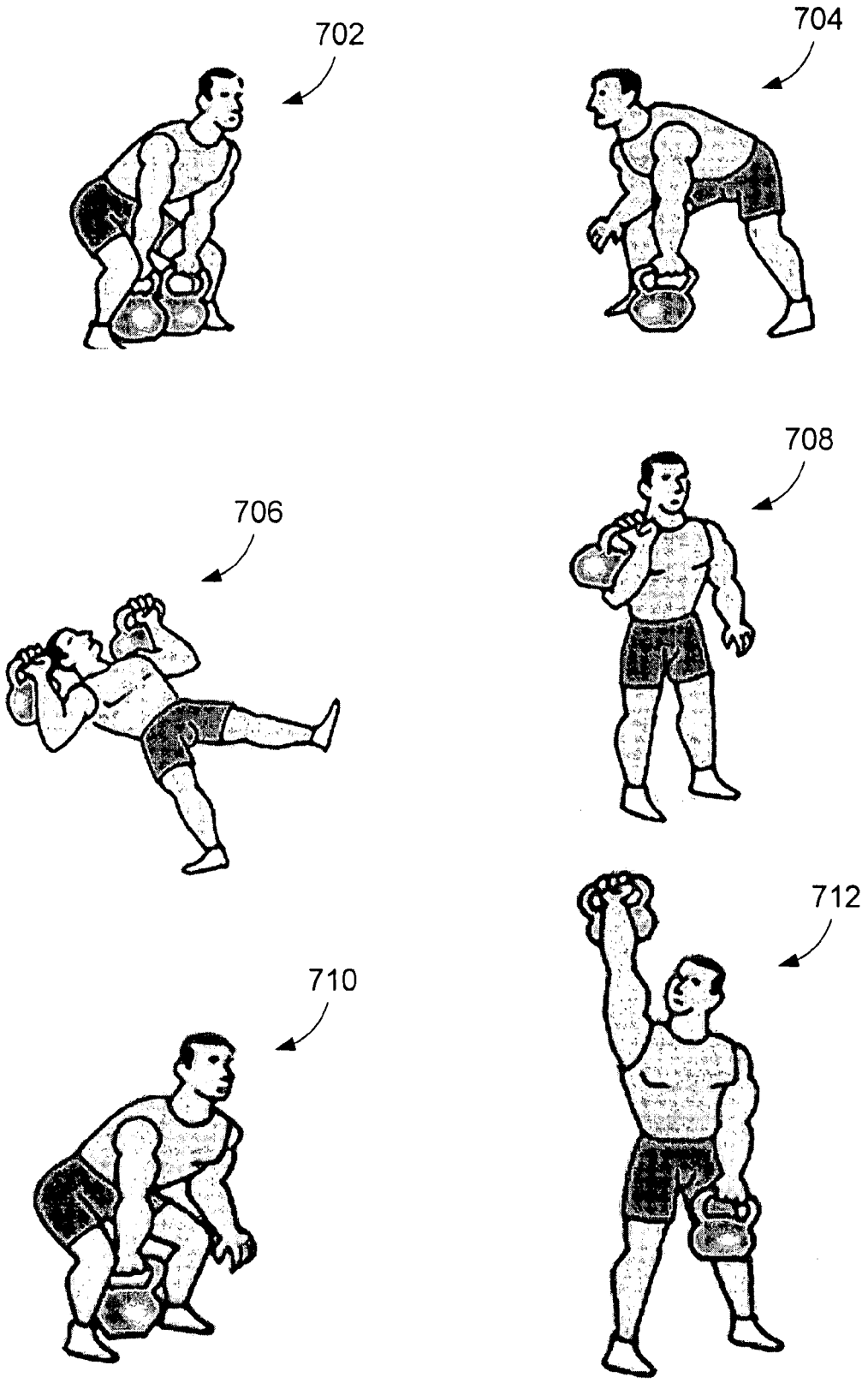
FIG. 7 shows a series of exemplary exercises performed using kettlebells.
Figure 8A:
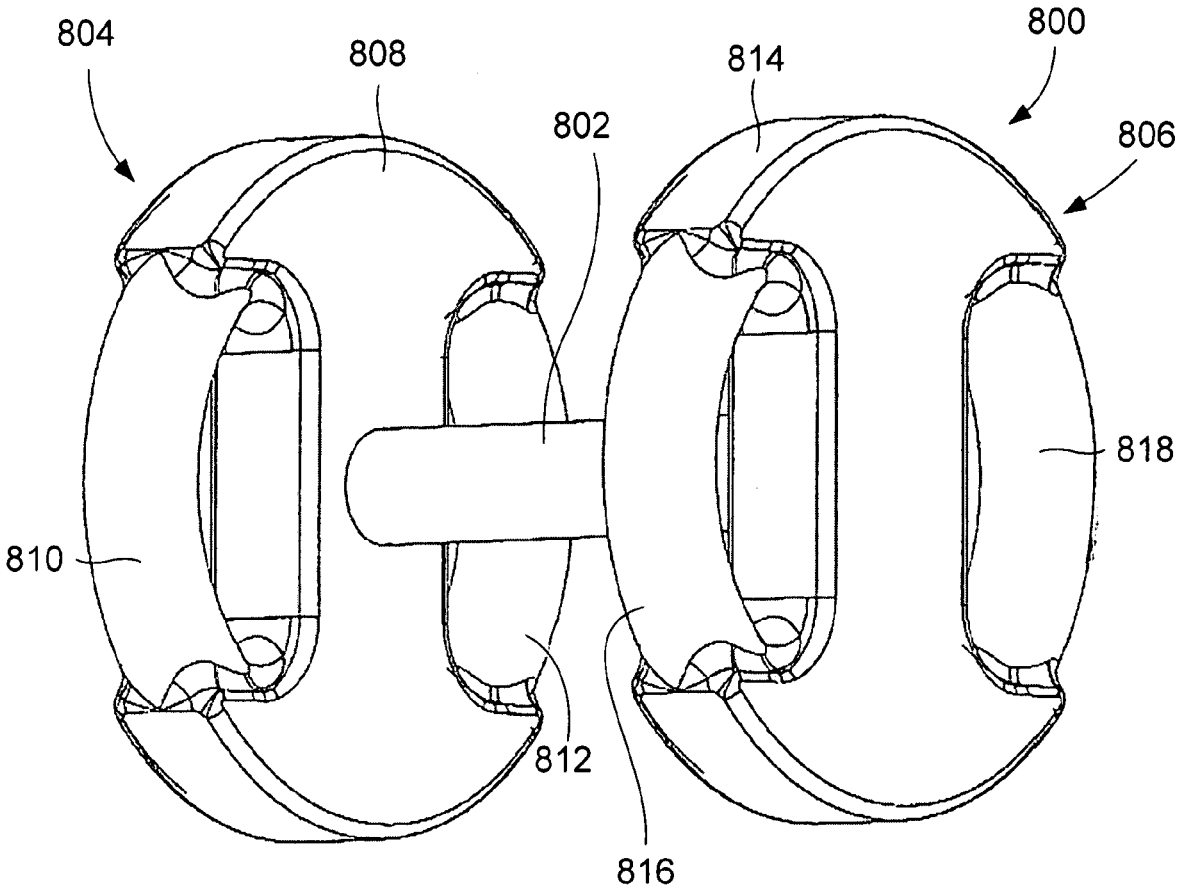
FIG. 8A shows a perspective view of a multi-grip dumbbell that represents one embodiment of the present invention.

FIG. 8A shows a perspective view of a multi-grip dumbbell that represents one embodiment of the present invention. A multi-grip dumbbell 800 includes a central handle 802, a first weighted head 804 in proximity to a first end of the central handle 802, and a second weighted head 806 in proximity to a second end of the central handle 802. The first weighted head 804 includes a weighted end handle 808 and two weighted side handles 810 and 812. Similarly, the second weighted head 806 includes a weighted end handle 814 and two weighted side handles 816 and 818.

Figure 8B:
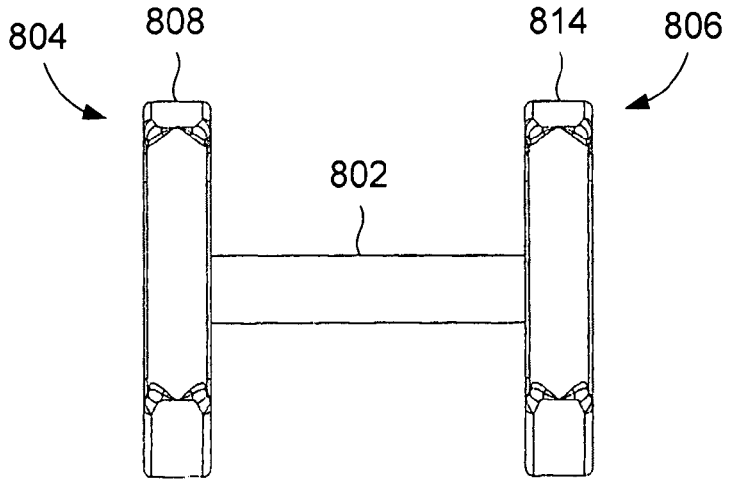
FIG. 8B shows a side view of the multi-grip dumbbell shown in FIG. 8A that represents one embodiment of the present invention.

FIG. 8B shows a side view of the multi-grip dumbbell shown in FIG. 8A that represents one embodiment of the present invention. The central handle 802 interconnects to the first weighted head 804 and to the second weighted head 806. The central handle 802 interconnects to the first weighted head 804 in proximity to the center of an interior surface of the first weighted end handle 808. Similarly, the central handle 802 interconnects to the second weighted head 806 in proximity to the center of an interior surface of the second weighted end handle 814. In FIG. 8B, the central handle 802 is cylindrical and the first weighted head 804 and the second weighted head 806 are substantially planar. Additionally, the first weighted head 804 and the second weighted head 806 are approximately parallel to each other and approximately orthogonal to the central handle 802. In alternate embodiments of the present invention, neither the first weighted head 804 nor the second weighted head 806 are substantially planar.

In one embodiment of the present invention, a central handle is interconnected to a first weighted head and to a second weighted head by pressing a first portion of the central handle into a first recess in proximity to the center of an inside surface of the first weighted head and pressing a second portion of the central handle into a second recess in proximity to the center of an inside surface of the second weighted head. In alternate embodiments of the present invention, a central handle is interconnected to a first weighted head and to a second weighted head by welding a central handle in proximity to the center of an inside surface of the first weighted head and in proximity to the center of an inside surface of the second weighted head. Various other means exist for interconnecting a central handle to a first weighted head and to a second weighted head, including both pressing and welding a central handle in proximity to the center of an inside surface of a first weighted head and in proximity to the center of an inside surface of a second weighted head, screwing a central handle to a recess in proximity to the center of both an inside surface of a first weighted head and in proximity to the center of an inside surface of a second weighted head, and bolting a central handle fully inserted through a mounting aperture positioned in proximity to the center of a first weighted head and a mounting aperture positioned in proximity to the center of a second weighted head. Note that, in FIGS. 8A-8B, the weighted heads 804 and 806 are aligned such that the weighted end handles are each in the same orientation. However, in alternate embodiments of the present invention, the weighted heads are non-aligned, thus the weighted end handles are not in the same orientation.

Figure 8C:
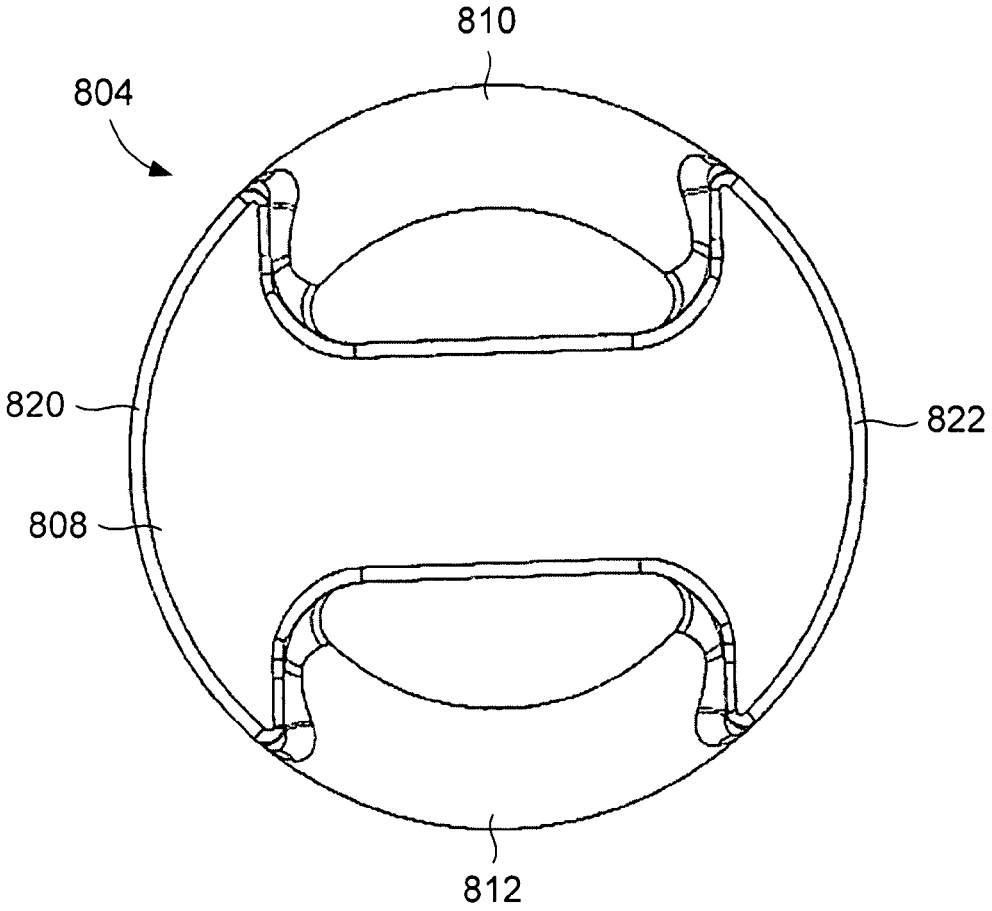
FIG. 8C shows an end view of the multi-grip dumbbell shown in FIG. 8A that represents one embodiment of the present invention.

FIG. 8C shows an end view of the multi-grip dumbbell shown in FIG. 8A that represents one embodiment of the present invention. In FIG. 8C, the first weighted head 804 is roughly disc-shaped, with the weighted end handle 808 bisecting the first weighted head 804. The weighted end handle 808 includes, two opposing ends 820 and 822, each opposing end 820 and 822 forming an arc along the perimeter of the first weighted head 804. Each weighted side handle 810 and 812 is curved in shape to form an arc along the perimeter of the first weighted head 804, with one end of each weighted side handle 810 and 812 interconnecting to the weighted end handle 808 in proximity to each of the opposing ends 820 and 822 of the weighted end handle 808. Collectively, the two opposing arc-shaped weighted side handles 810 and 812 and the two opposing arc-shaped ends 820 and 822 of the weighted end handle 808 create the disc shape of the first weighted head 804. Note that, in the embodiment of the present invention shown in FIGS. 8A-8C, there are two open regions between the weighted end handle 808 and each of the weighted side handles 810 and 812. The open regions are defined by being medial to each weighted side handle 810 and 812 and lateral to the weighted end handle 808 and provide space to accommodate a portion of a user's hand as a user grips the weighted end handle 808 and/or one or more of the weighted side handles 810 and 812.

In FIG. 8C, the weighted side handles 810 and 812 are shown with round circumferences for gripping and are on opposite sides of the first weighted head 804 from one another. In one embodiment of the present invention, a weighted head is a unitary structure and is fabricated from a single mold. In alternate embodiments of the present invention, the weighted end handle and the weighted side handles are separate pieces that are fabricated separately and subsequently interconnected. In one embodiment of the present invention, each end of a weighted side handle is welded to a weighted end handle. Various other methods of interconnecting weighted side handles to a weighted end handle may be used, including using an epoxy, pressing one or more ends of a weighted side handle into one or more recesses within a weighted end handle, screwing a weighted side handle to a weighted end handle, or bolting a weighted side handle to a weighted end handle.

Figure 9:
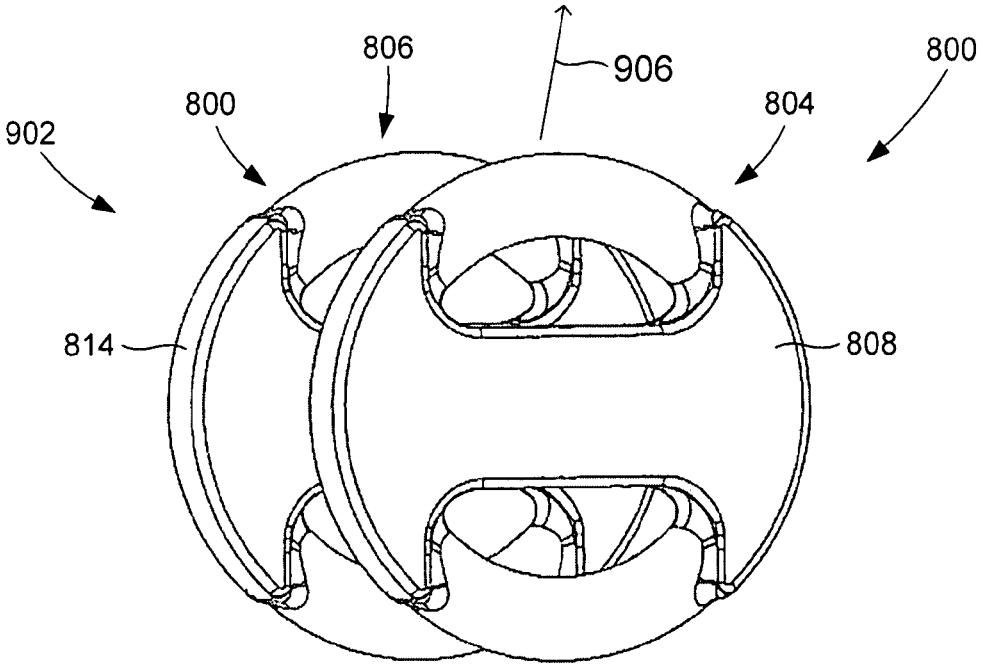
FIG. 9 shows two different orientations of weighted end handles on the multi-grip dumbbell shown in FIG. 8A that represents one embodiment of the present invention.
Figure 9:
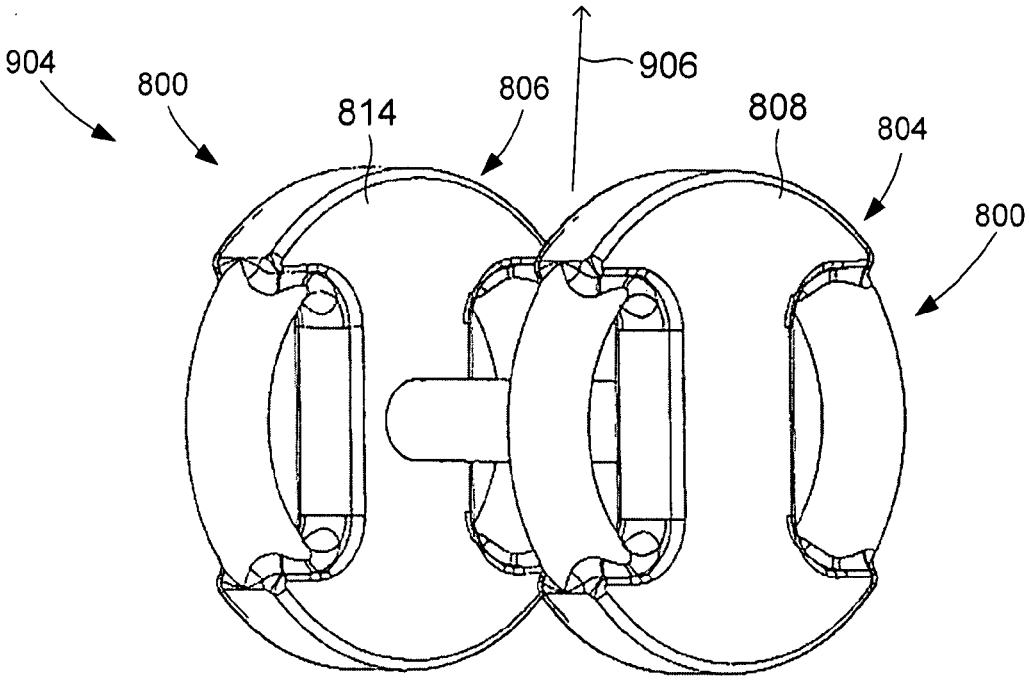

In one embodiment of the present invention, a weighted head for a multi-grip dumbbell is weighted such that the weight distribution in the weighted head is not affected by the orientation of a weighted end handle along an axis defined by the central handle. FIG. 9 shows two different orientations of weighted end handles on the multi-grip dumbbell shown in FIG. 8A that represents one embodiment of the present invention. A first orientation 902 shows the weighted end handles 808 and 814 positioned horizontally, while a second orientation 904 shows the weighted end handles 808 and 814 positioned vertically. The weight distribution of the multi-grip dumbbell 800 is approximately equal in all directions in planes perpendicular to an axis defined by a central handle. Accordingly, the weighted side handles 810, 812, 816, and 818 are weighted such that, in either orientation 902 or 904, the distribution of weight in the first weighted head 804 and the second weighted head 806 remains similar when the multi-grip dumbbell 800 is lifted in a direction indicated by directional arrow 906. Thus, the multi-grip dumbbell 800 may be used in a manner that is similar to a dumbbell, with a user gripping a central handle, without the need for orienting the multi-grip dumbbell so that the weighted end handles are in a specific orientation prior to use in order to obtain a specific center of gravity.

Figure 10:
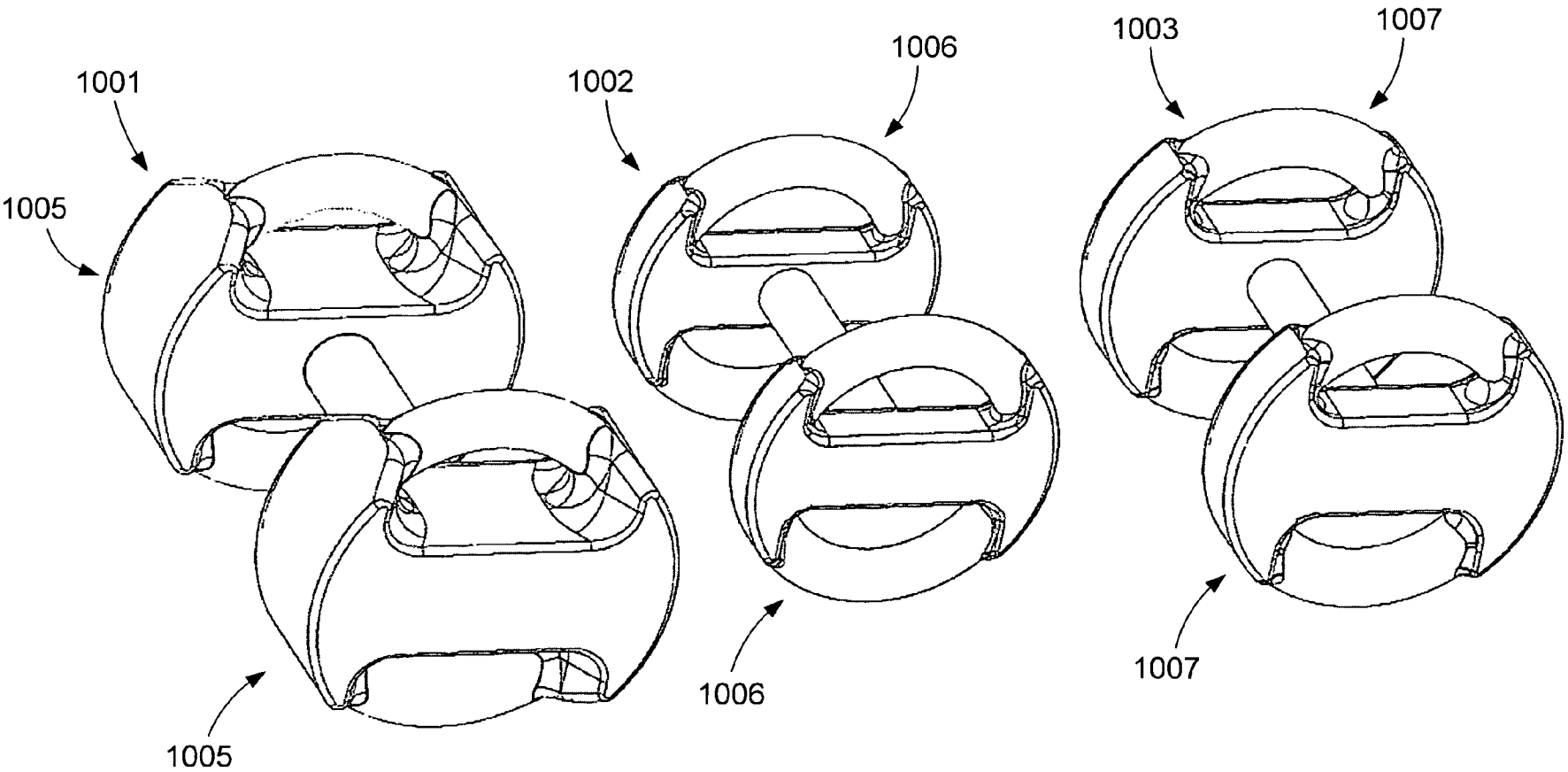
FIG. 10 shows a perspective view of three multi-grip dumbbells with differently-sized weighted-head pairs that represent three embodiments of the present invention.

Multi-grip dumbbells may include a first weighted head and a second weighted head ("weighted-head pairs") of various similar sizes. FIG. 10 shows a perspective view of three multi-grip dumbbells with differently-sized weighted-head pairs that represent three embodiments of the present invention. Three multi-grip dumbbells 1001-1003 include weighted-head pairs 1005-1007, respectively. In FIG. 10, the weighted-head pair 1007 on the multi-grip dumbbell 1003 is larger in size than the weighted-head pair 1006 on the multi-grip dumbbell 1002. Similarly, the weighted-head pair 1005 on the multi-grip dumbbell 1001 is larger in size than the weighted-head pair 1007 on the multi-grip dumbbell 1003. In one embodiment of the present invention, an increase in the size of a weighted-head pair results in an increase in weight of a corresponding multi-grip dumbbell. In one embodiment of the present invention, changes in the size of weighted heads for variously weighted multi-grip dumbbells also results in changes in the circumference of the corresponding weighted side handles. In another embodiment of the present invention, despite changes in the size of weighted heads for variously weighted multi-grip dumbbells, the size of a corresponding central handle remains a constant length and diameter.

Figure 11A:
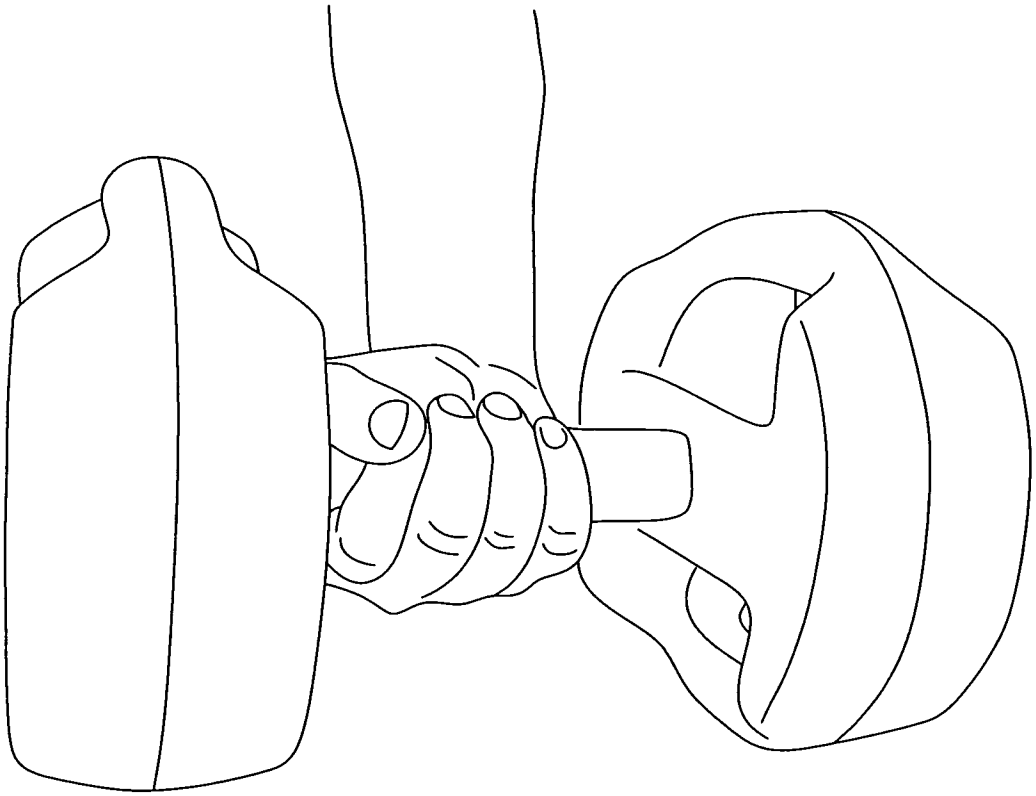
FIGS. 11A-11C show a series of three exemplary one-handed gripping techniques using multi-grip dumbbells that represent one embodiment of the present invention.
Figure 11B:
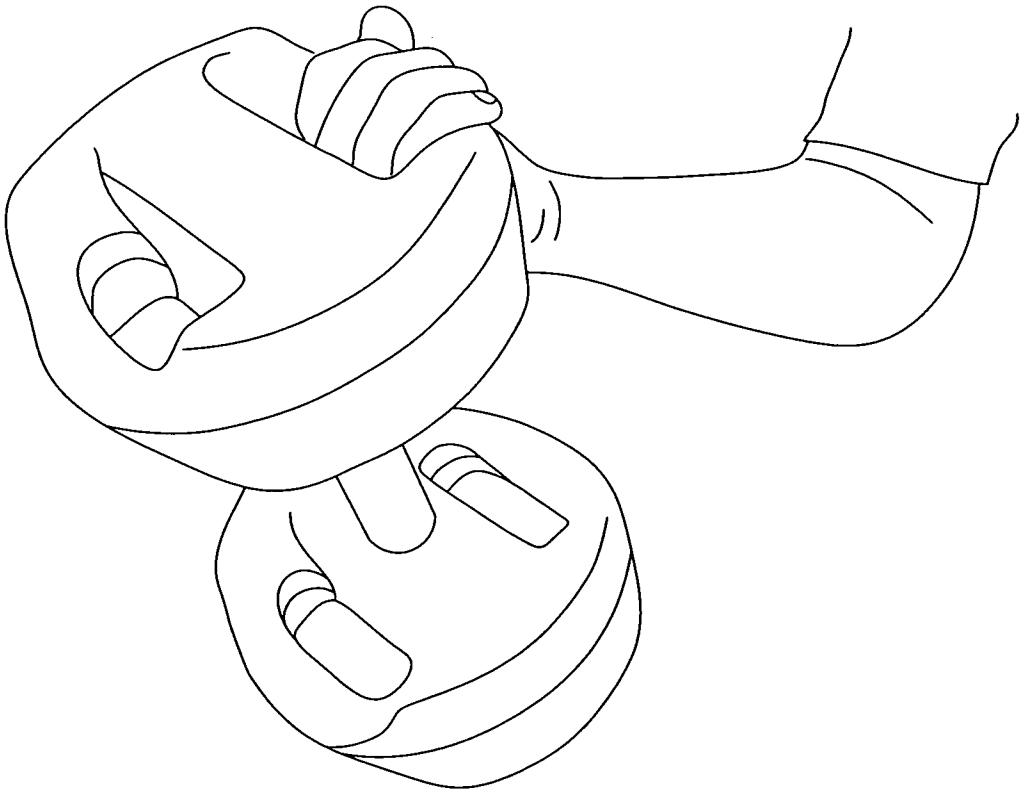
Figure 11C:
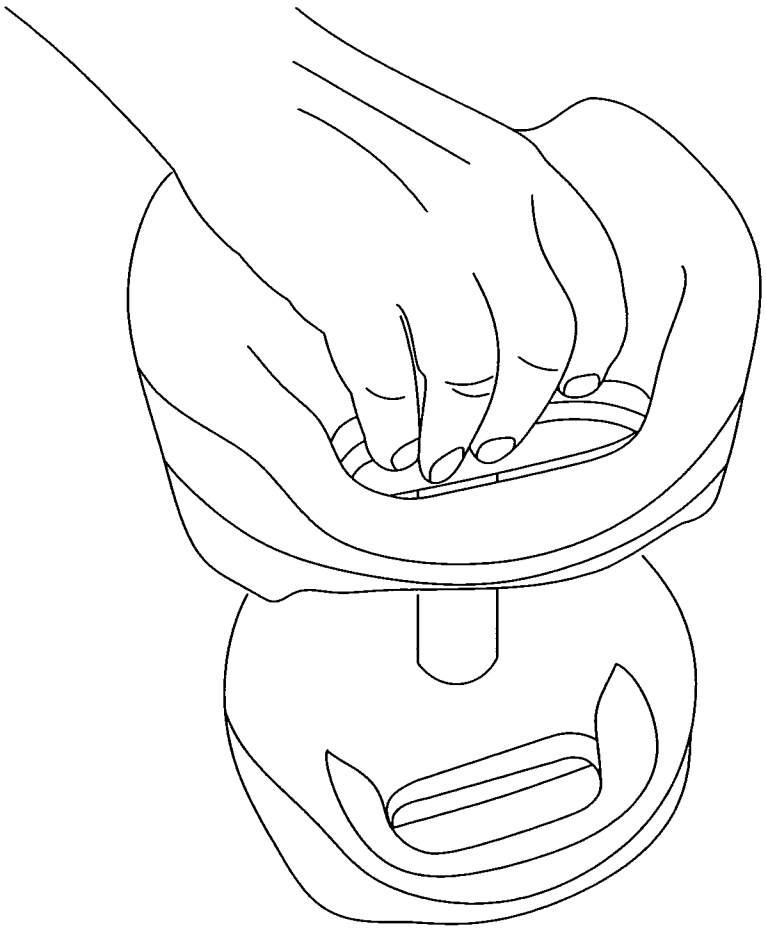

Multi-grip dumbbells may be used either singly or in pairs. Additionally, multi-grip dumbbells may be gripped with either one hand or with two hands in a number of different ways, such as by using a central handle, using one or more weighted side handles, and/or using one or more weighted end handles. FIGS. 11A-11C show a series of three exemplary one-handed gripping techniques using multi-grip dumbbells that represent one embodiment of the present invention. FIG. 11A shows a user gripping a central bar of a multi-grip dumbbell that represents one embodiment of the present invention. FIG. 11B shows a user gripping a weighted side handle of a multi-grip dumbbell that represents one embodiment of the present invention. FIG. 11C shows a user gripping a weighted end handle of a multi-grip dumbbell that represents one embodiment of the present invention. Note that, in FIGS. 11A-11B the central handle and weighted side handles may be gripped such that a user's arm is in either a pronated or a supinated position. Note also that, in FIG. 11C a weighted end handle may be gripped from either an outer side of a weighted head, as shown in FIG. 11C, or from an inner side of a weighted head, opposite from the side shown in FIG. 11C.

Figure 12A:
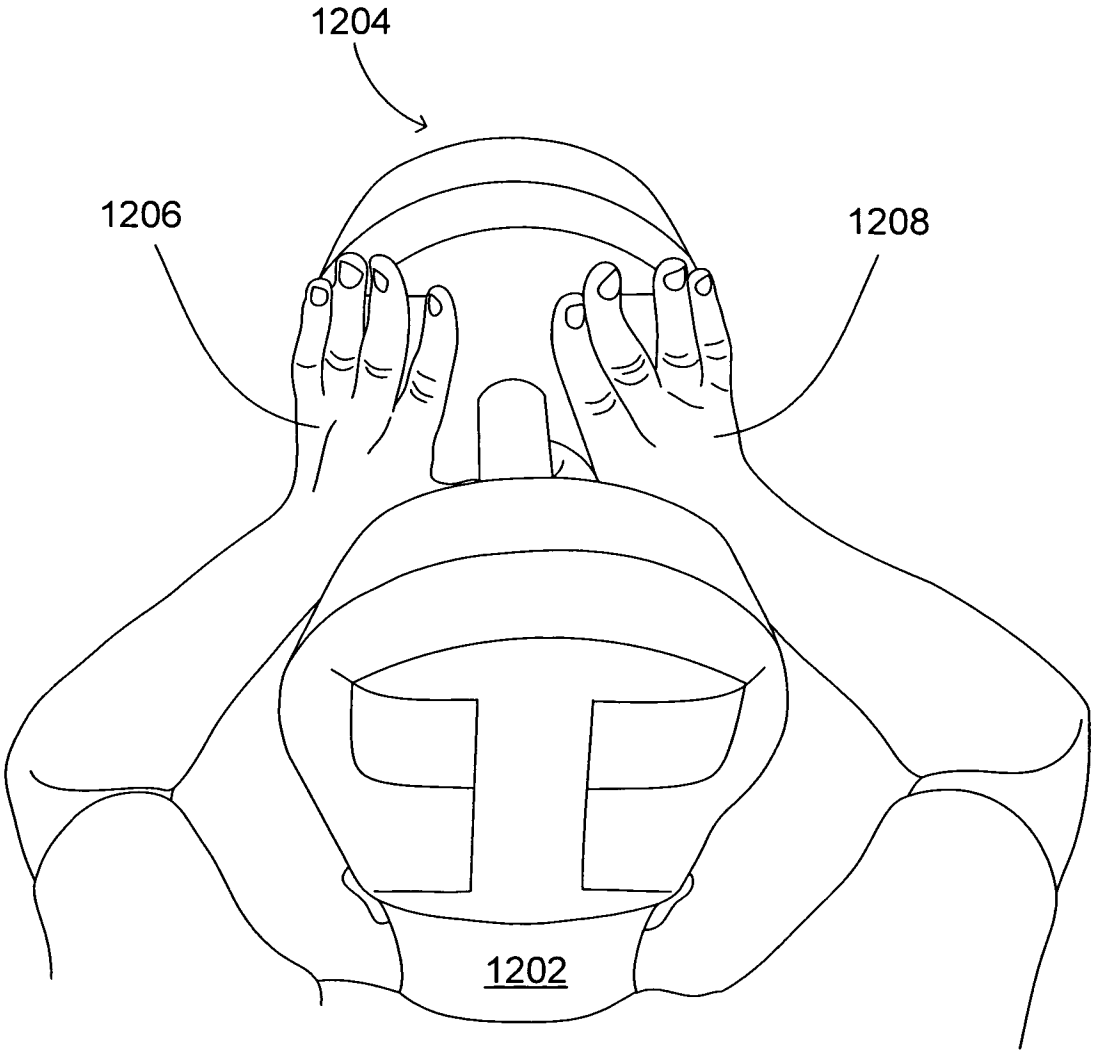
FIGS. 12A-12C show a series of three different two-handed grips that a user may employ to perform a French curl using a multi-grip dumbbell that represents one embodiment of the present invention.
Figure 12B:
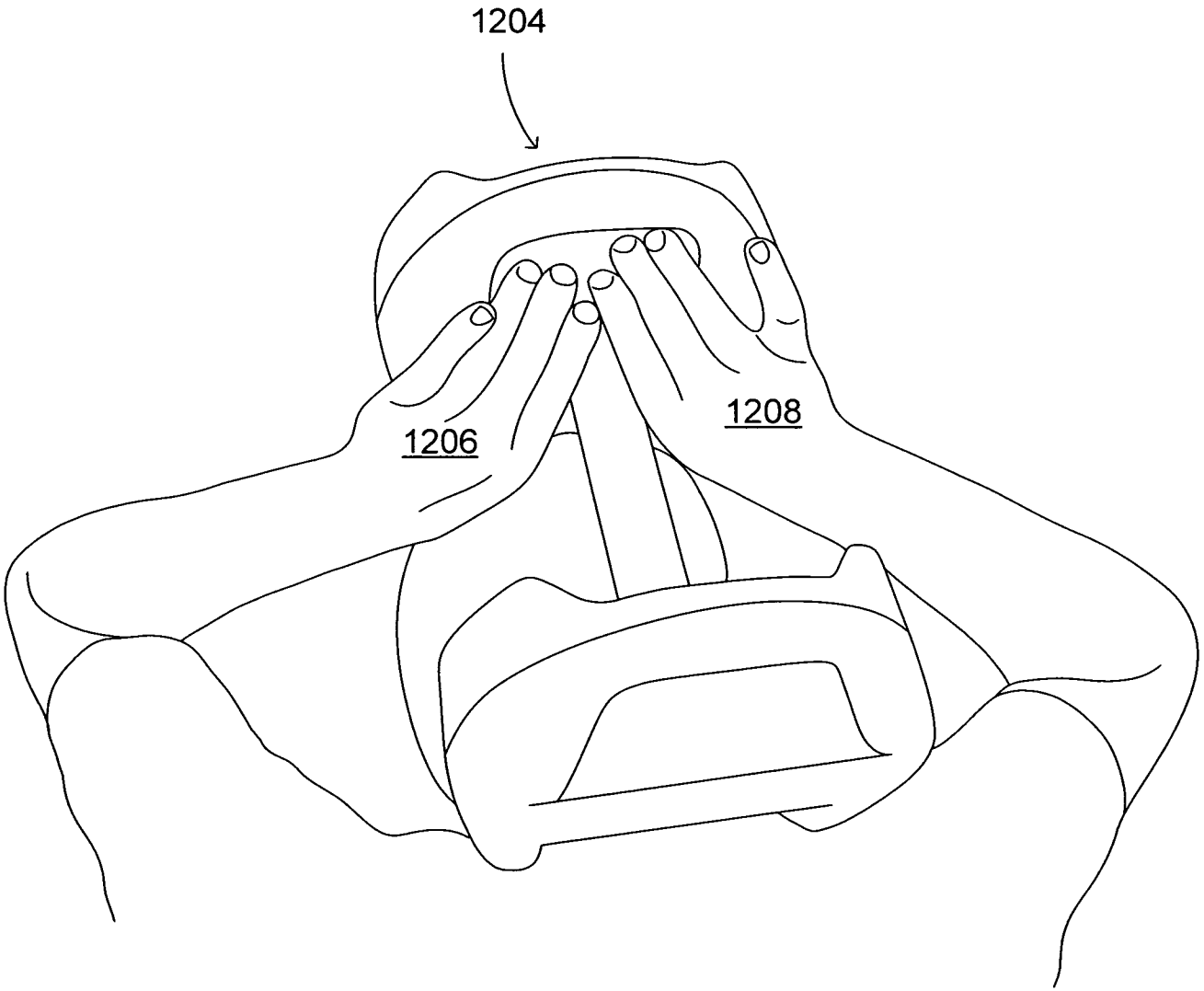
Figure 12C:
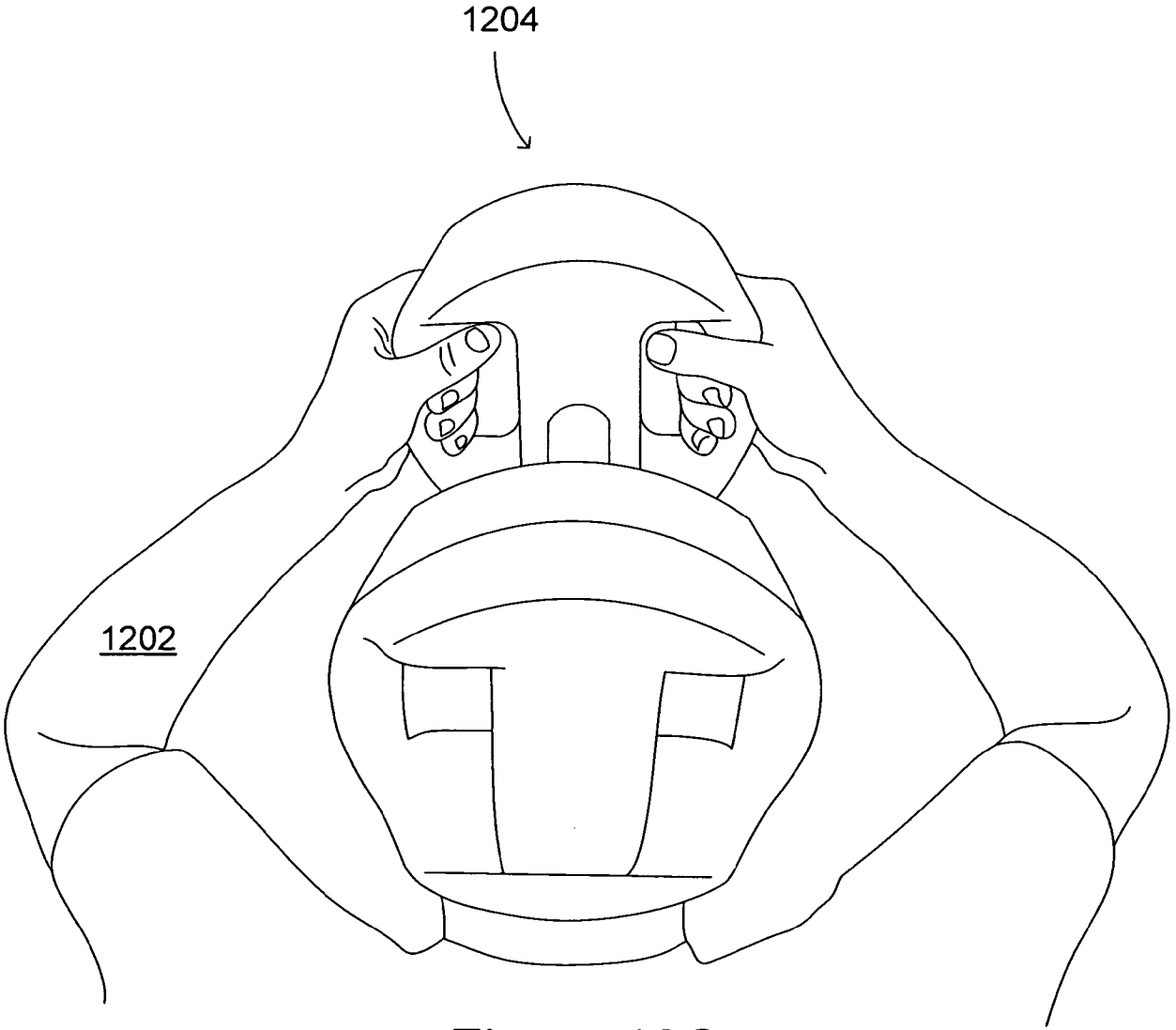

Performing exercises by using a variety of different hand grips may introduce variations of leverage, torque, center of gravity, and overall difficulty which may improve overall strength, balance, and comfort. FIGS. 12A-12C show a series of three different two-handed grips that a user may employ to perform a French curl using a multi-grip dumbbell that represents one embodiment of the present invention. FIG. 12A shows a first French-curl-gripping technique for a multi-grip dumbbell that represents one embodiment of the present invention. In FIG. 12A, a user 1202 is gripping a multi-grip dumbbell 1204 by maintaining the palms and fingers of his hands 1206 and 1208 in a flat orientation and placing his palms against an inner surface of a pair of weighted side handles on a weighted head. FIG. 12B shows a second French-curl gripping technique for a multi-grip dumbbell that represents one embodiment of the present invention. In FIG. 12B, the user 1202 is gripping the multi-grip dumbbell 1204 on an inner side of a weighted end handle. The user 1202 is placing the palms of his hands 1206 and 1208 along an inner surface of a weighted head and wrapping his fingers into a first open region between the weighted end handle and a first weighted side handle, and wrapping his thumb into a second open region between the weighted end handle and a second weighted side handle. FIG. 12C shows a third French-curl gripping technique for a multi-grip dumbbell that represents one embodiment of the present invention. In FIG. 12C, the user 1202 is holding the multi-grip dumbbell 1204 by gripping a pair of weighted side handles on one of the weighted heads.

Figure 13A:
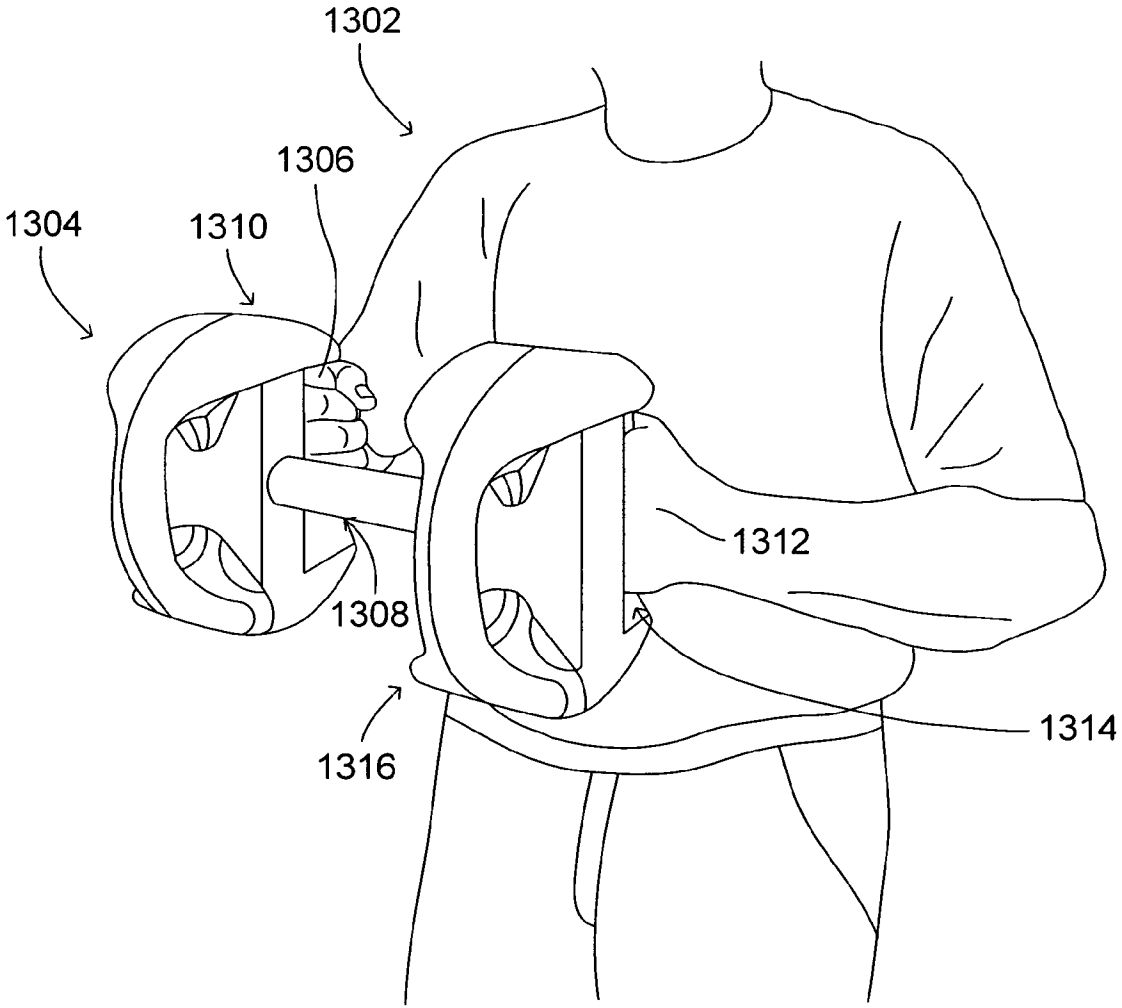
FIGS. 13A-13C show a series of three alternate two-handed gripping positions that may be used while performing an exercise using a multi-grip dumbbell that represents one embodiment of the present invention.
Figure 13B:
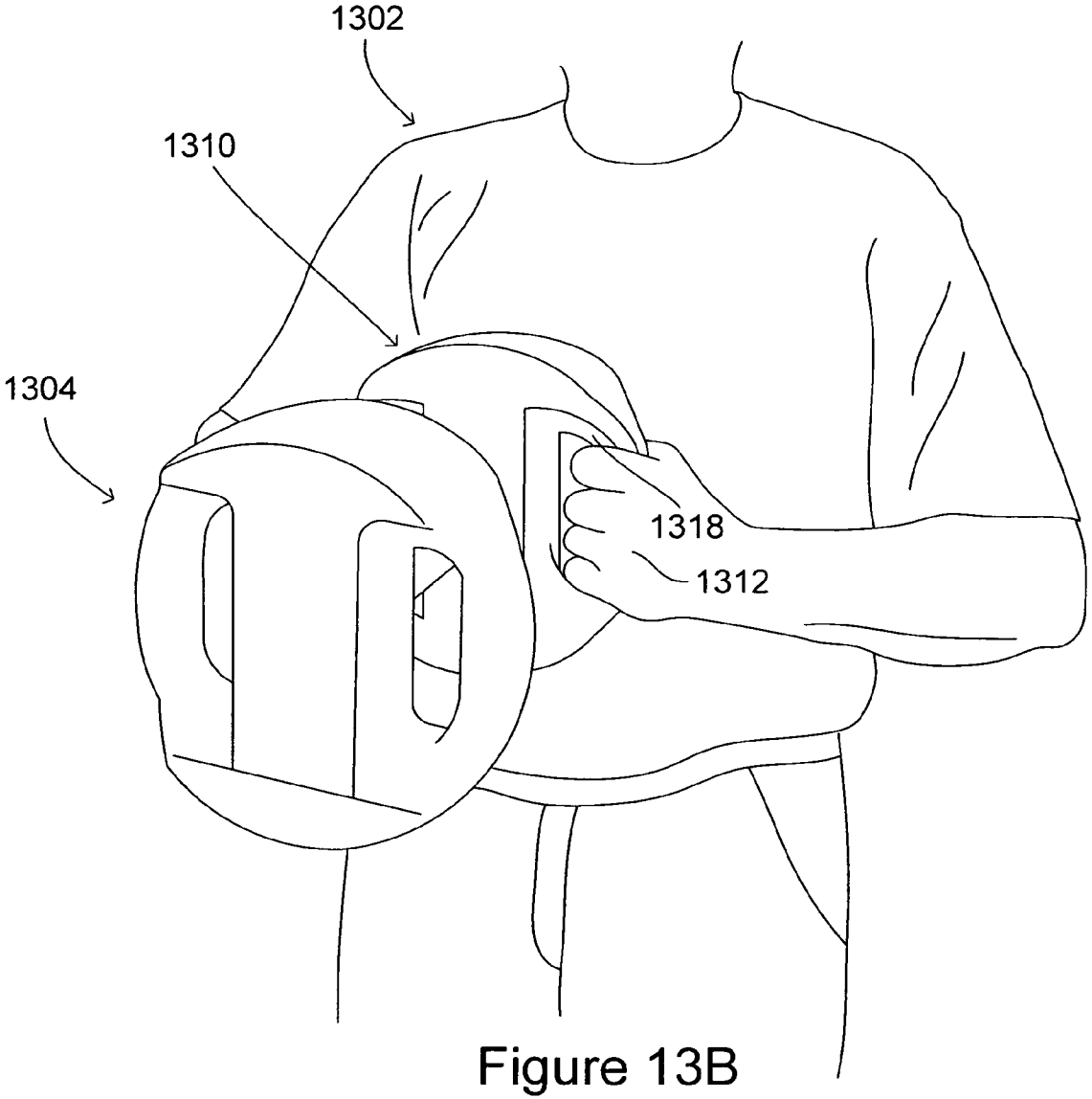
Figure 13C:
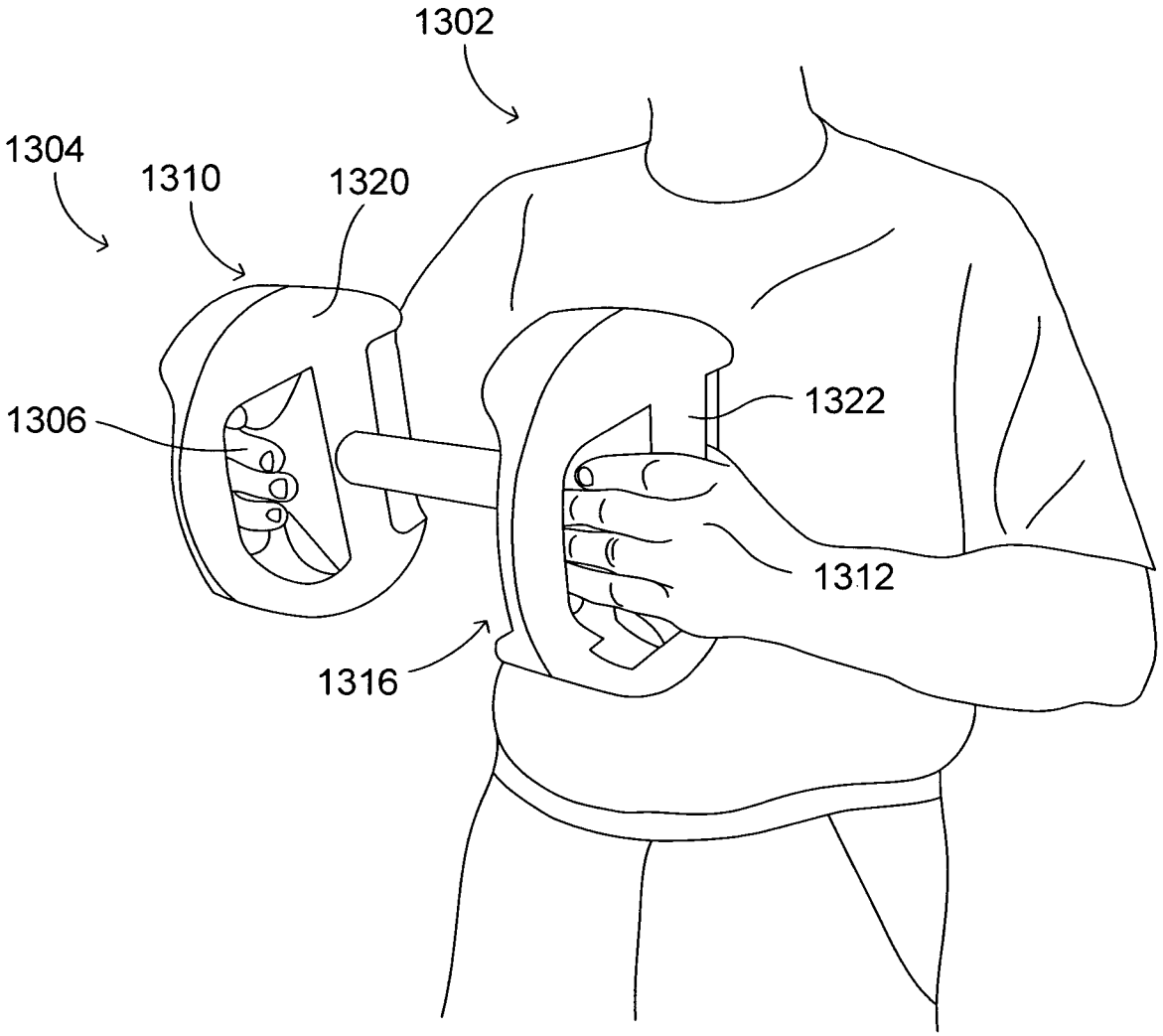

Alternate leverages may be created by utilizing various hand grips while performing a given exercise using a multi-grip dumbbell. Utilizing various hand grips may alter the difficulty of a given exercise by changing the center of gravity of a multi-grip dumbbell and consequently changing the leverage available to the user while performing the given exercise. FIGS. 13A-13C show a series of three alternate two-handed gripping positions that may be used while performing an exercise using a multi-grip dumbbell that represents one embodiment of the present invention. FIG. 13A shows a first two-handed gripping position for performing an exercise using a multi-grip dumbbell that represents one embodiment of the present invention. In FIG. 13A, a user 1302 is gripping a multi-grip dumbbell 1304 by placing a first hand 1306 on a weighted side handle 1308 on a first weighted head 1310 and placing a second hand 1312 on a weighted side handle 1314 on a second weighted head 1316. FIG. 13B shows a second two-handed gripping position for performing the exercise shown in FIG. 13A using a multi-grip dumbbell that represents one embodiment of the present invention. In FIG. 13B, the user 1302 is gripping the multi-grip dumbbell 1304 by placing his first hand (1306 in FIG. 13A) on the weighted side handle (1308 FIG. 13A) on the first weighted head 1310 and placing his second hand 1312 on the weighted side handle 1318 on the first weighted head 1310. FIG. 13C shows a third two-handed gripping position for performing the exercise shown in FIG. 13A using a multi-grip dumbbell that represents one embodiment of the present invention. In FIG. 13C, the user 1302 is gripping the multi-grip dumbbell 1304 by placing his first hand 1306 on an outer surface of a weighted end handle 1320 on the weighted head 1310 and placing his second hand 1312 on an outer surface of a weighted end handle 1322 on the weighted head 1316.

Figure 14:
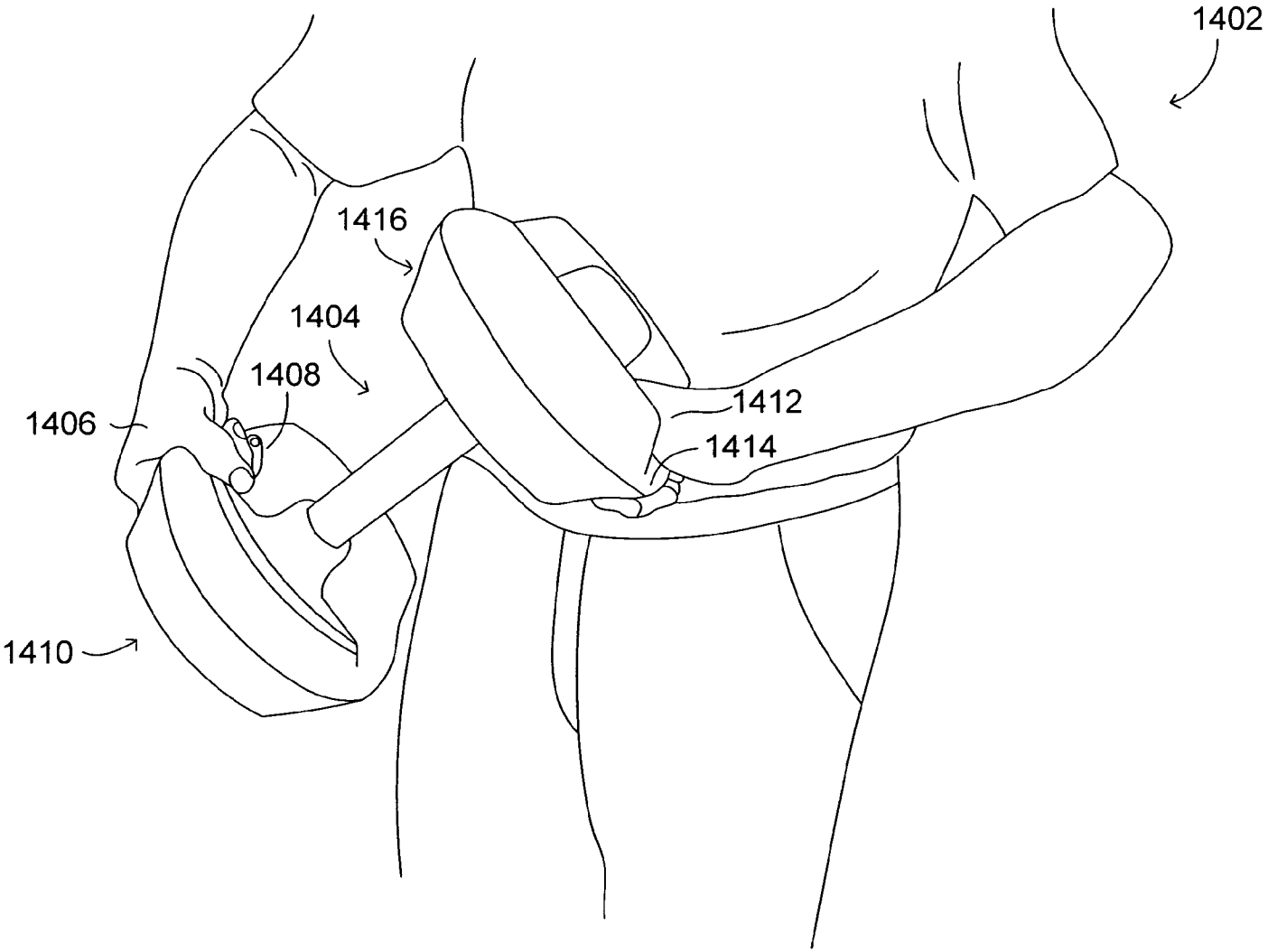
FIG. 14 shows a user utilizing an asymmetric two-handed grip on a multi-grip dumbbell that represents one embodiment of the present invention.

Alternate two-handed gripping techniques may also be utilized to perform asymmetric exercises wherein two symmetric muscles, such as two biceps, are exercised differently while both gripping the same free weight. FIG. 14 shows a user utilizing an asymmetric two-handed grip on a multi-grip dumbbell that represents one embodiment of the present invention. In FIG. 14, a user 1404 is holding a multi-grip dumbbell 1404.

The user's first hand 1406 is gripping a weighted side handle 1408 on a first weighted head 1410 while the user's second hand 1412 is gripping a weighted side handle 1414 on an opposite side of a second weighted head 1416. Various other types of asymmetric two-handed gripping techniques may also be utilized, including placing a first hand on a weighted side handle and a second hand on a central handle, placing a first hand on a weighted side handle and a second hand on a weighted end handle, placing a first hand on a central handle and a second hand on a weighted end handle, and other asymmetric two-handed gripping techniques.

Figure 15:
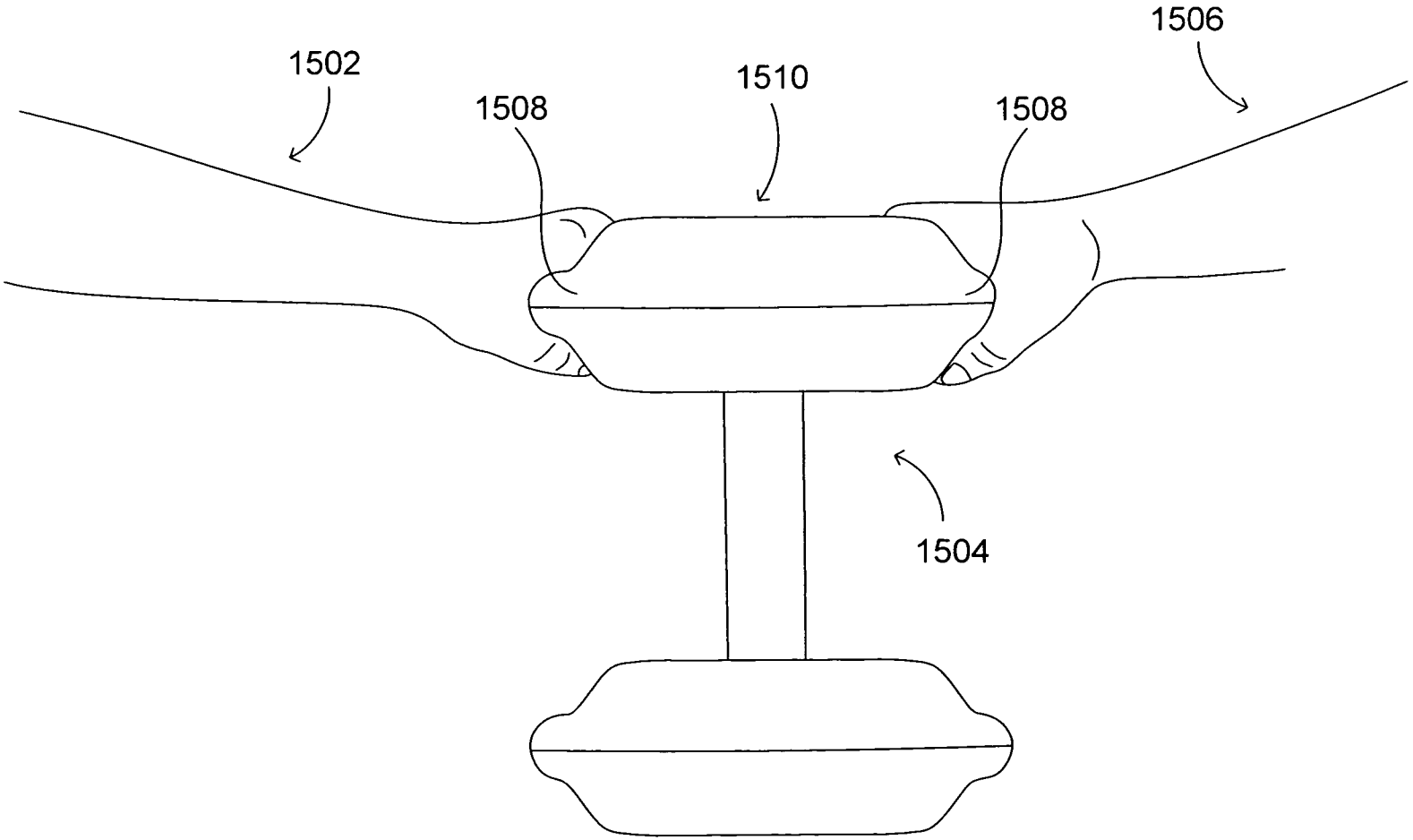
FIG. 15 shows a first user passing to a second user a multi-grip dumbbell that represents one embodiment of the present invention.

Providing multiple handles on a multi-grip dumbbell may facilitate the passing of one or more multi-grip dumbbells between two or more users. FIG. 15 shows a first user passing to a second user a multi-grip dumbbell that represents one embodiment of the present invention. In FIG. 15, a first user 1502 is passing a multi-grip dumbbell 1504 to a second user 1506. The first user 1502 is gripping the multi-grip dumbbell 1504 by a weighted side handle 1508 on a first weighted head 1510. The second user 1506 is gripping the multi-grip dumbbell 1504 by a weighted side handle 1512 on the first weighted head 1510. Various alternate passing techniques may be utilized, including a first user gripping a multi-grip dumbbell by a weighted side handle on a first weighted head and a second user gripping the multi-grip dumbbell by a weighted side handle on a second weighted head, a first user gripping a multi-grip dumbbell by a central handle and a second user gripping the multi-grip dumbbell by a weighted side handle, a first user gripping a multi-grip dumbbell by a weighted side handle and a second user gripping the multi-grip dumbbell by a central handle, a first user gripping a multi-grip dumbbell by a central handle and a second user gripping the multi-grip dumbbell by a weighted end handle, a first user gripping a multi-grip dumbbell by a weighted end handle and a second user gripping the multi-grip dumbbell by a central handle, a first user gripping a multi-grip dumbbell by a weighted end handle and a second user gripping the multi-grip dumbbell by a weighted end handle, a first user gripping a multi-grip dumbbell by a weighted side handle and a second user gripping the multi-grip dumbbell by a weighted end handle, a first user gripping a multi-grip dumbbell by a weighted end handle and a second user gripping the multi-grip dumbbell by a weighted side handle, and various other passing techniques. Note that the passing technique shown in FIG. 15, as well as the various other passing techniques listed above, utilize a one-handed passing of a multi-grip dumbbell. A multi-grip dumbbell may also be passed using two hands using various combinations of the central handle, weighted end handles, and weighted side handles. Using two hands may be safer than using one hand because multiple grips may be used to promote a better grip and to distribute the weight of a multi-grip dumbbell.

Figure 16A:
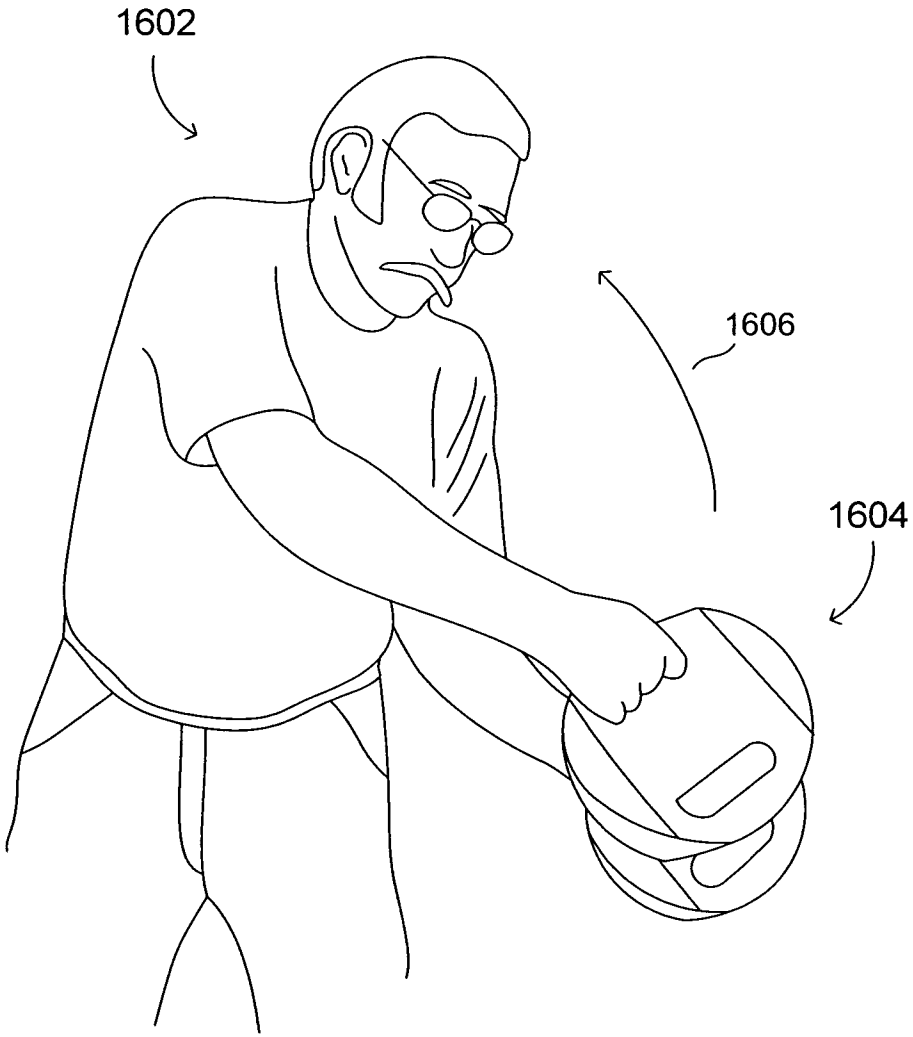
FIGS. 16A-16C show a user performing a two-handed dynamic exercise using a multi-grip dumbbell that represents one embodiment of the present invention.
Figure 16B:
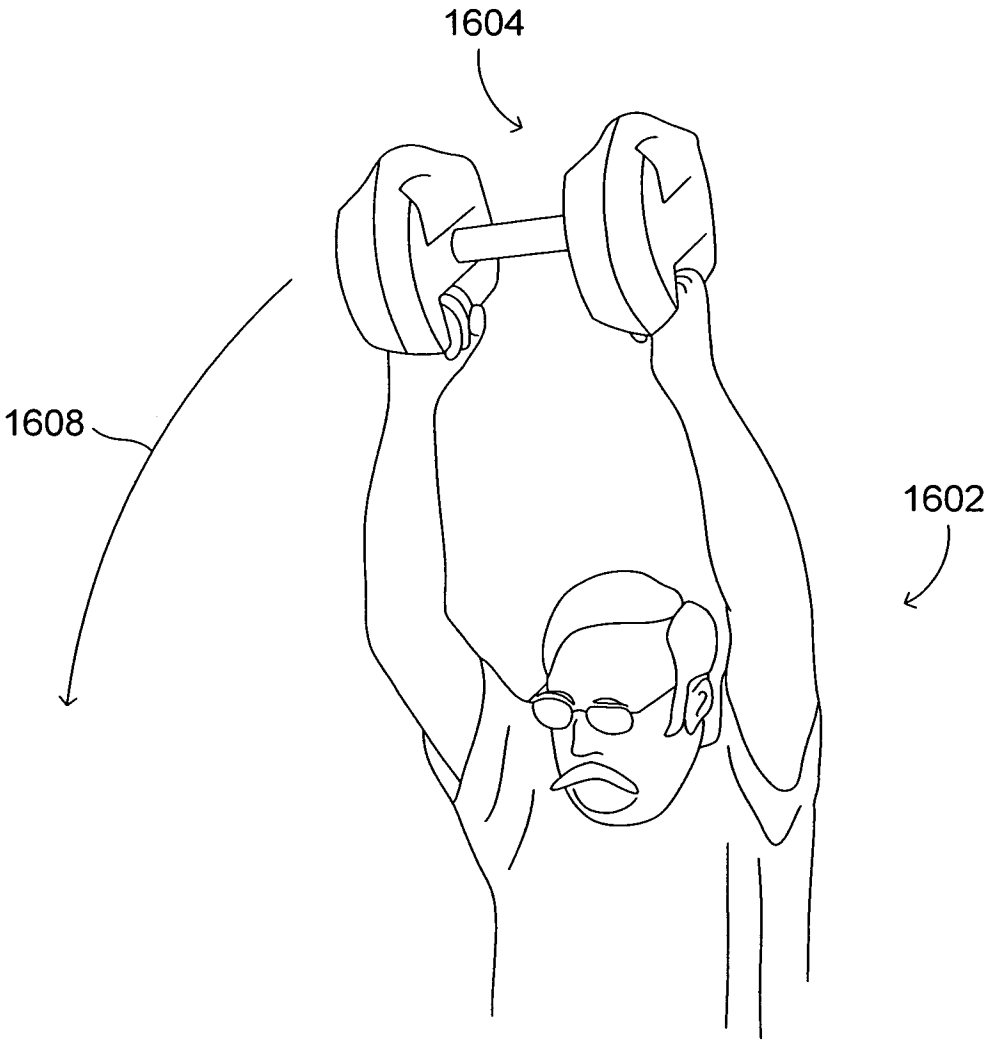
Figure 16C:
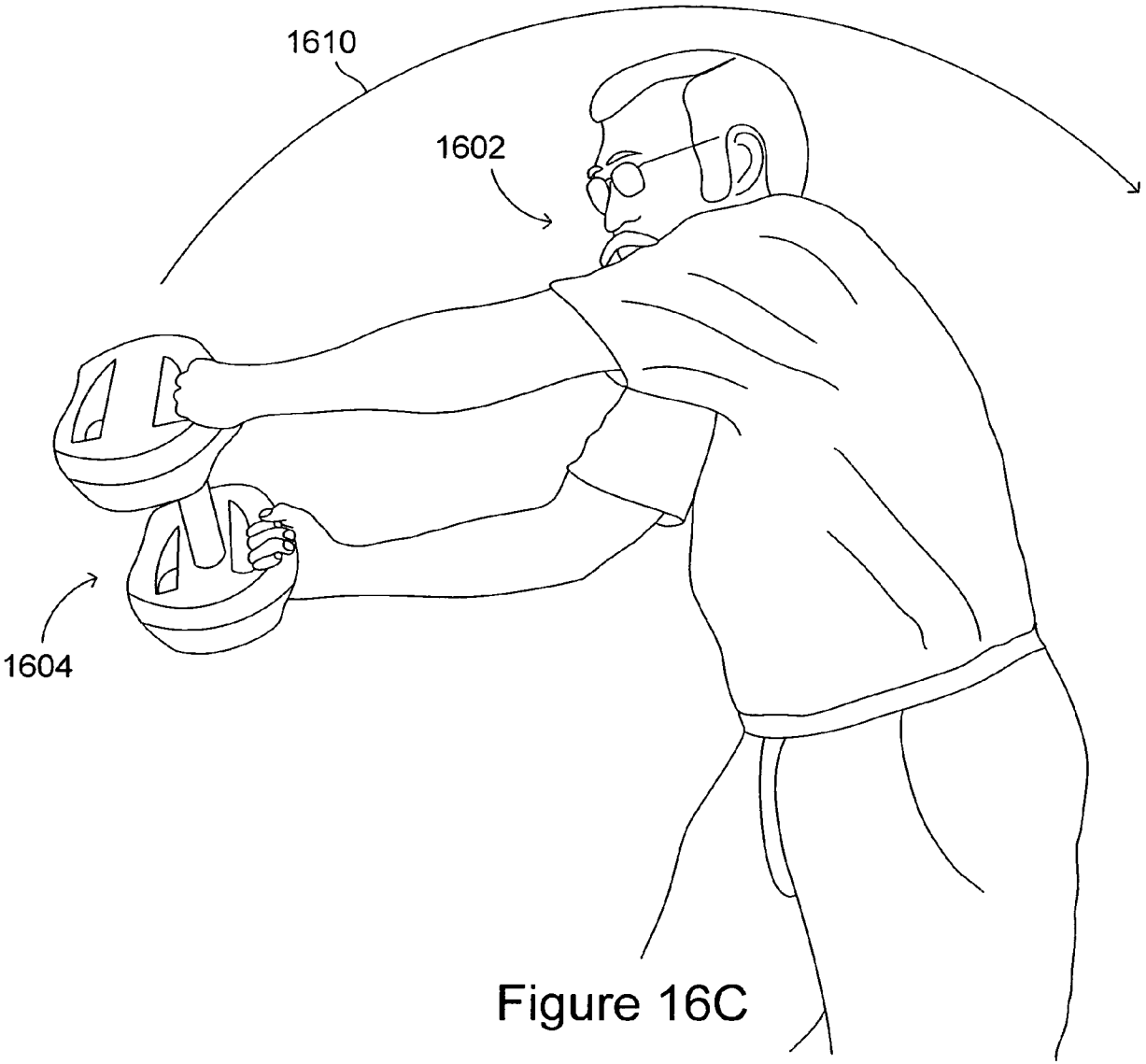

Providing multiple handles on a multi-grip dumbbell may facilitate the performance of dynamic exercises that involve multiple movements and that may not be safe to perform with a standard dumbbell or kettlebell and may also not be feasible to perform with a barbell. FIGS. 16A-16C show a user performing a two-handed dynamic exercise using a multi-grip dumbbell that represents one embodiment of the present invention. In FIG. 16A, a user 1602 is gripping a multi-grip dumbbell 1604 by a weighted side handle on each of two weighted heads. The user 1602 is holding the multi-grip dumbbell 1604 to his left and is moving the multi-grip dumbbell 1604 upward in an arced direction, represented in FIG. 16A by a directional arrow 1606. In FIG. 16B, the user 1602 is holding the multi-grip dumbbell 1604 over his head and is moving the multi-grip dumbbell 1604 downward in an arced direction, represented in FIG. 16B by a directional arrow 1608. In FIG. 16C, the user 1602 is holding the multi-grip dumbbell 1604 to his right and is moving the multi-grip dumbbell 1604 upward in an arced direction reversed from FIGS. 16A and 16B, represented in FIG. 16C by a directional arrow 1610. Providing multiple handles on a multi-grip dumbbell also facilitates the performance of other dynamic exercises that involve multiple movements, such as continually rotating different grips on a multi-grip dumbbell using either one or two hands, or flipping a multi-grip dumbbell in the air, thus rotating from a first grip to a second grip on the same location or on a different location on the multi-grip dumbbell using either one or two hands.

Providing multiple handles on a multi-grip dumbbell promotes safety. Spotting may be utilized by either a user or a third party. For example, a user may utilize multiple grips to perform an exercise by lifting a multi-grip dumbbell by a first handle with a first hand, while using a second hand on a different handle to provide self-assistance, for example, when a user becomes fatigued using the first hand. Additionally, a user may perform an exercise using one or two hands on one or two grips while a third-party spotter uses one or two other grips to spot the user and provide assistance when needed. In addition to promoting safety, providing a spotter may also improve strength by allowing a user to lift heavier weights or perform additional repetitions when a user begins to become fatigued.

Additional modifications within the spirit of the invention will be apparent to those skilled in the art. For example, a multi-grip dumbbell may be either an adjustable-weight dumbbell or a fixed-weight dumbbell. Accordingly, weighted heads may be either removably or permanently attached to a central handle. Multiple weighted ends may be attached in proximity to each end of a central handle. A multi-grip dumbbell may be composed of a number of different materials, including steel, cast iron, urethane, plastic, foam, chrome, and other durable materials. A multi-grip dumbbell may also be composed of a number of different vanity materials, including gold, silver, platinum, titanium, and other vanity materials. Weighted heads may be of shapes other than disc-shaped, such as an octagonal-shaped or dodecahedral-shaped. Weighted heads may be fabricated in a number of different colours. Weighted end handles may be chamfered and/or grooved. Weighted side handles may be arc-shaped or of some other partially-polygonal shape, such as a partially-octagonal-shaped or partially-dodecahedral-shaped. Weighted side handles may include a non-round circumference, such as a U-shaped circumference, an oval circumference, or some other shaped circumference suitable for gripping. More than two weighted side handles may be positioned on a weighted head. A central handle may include knurling and/or tapering to promote a tighter grip. A weighted side handle may include knurling and/or tapering to promote a tighter grip. A weighted end handle may include knurling and/or tapering to promote a tighter grip. The length of a central handle may range from two inches to three feet. The diameter of a weighted head may range from two inches to three feet. A multi-grip dumbbell may be coated with a resilient coating, including rubber, polyurethane, plastic, neoprene, non-chip paint, chrome plating, or other resilient coating to minimize the danger of injury and/or to enhance the appearance of the multi-grip dumbbell. The resilient coating may be pigmented.

The foregoing detailed description, for purposes of illustration, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description; they are not intended to be exhaustive or to limit the invention to the precise forms disclosed. Obviously many modifications and variation are possible in view of the above teachings. The embodiments were chosen and described in order to best explain the principles of the invention and its practical applications and to thereby enable others skilled in the art to best utilize the invention and various embodiments with various modifications as are suited to the particular use contemplated.

The invention claimed is:

1. A multi-grip dumbbell comprising:

a central handle having a first end and a second end;

a first weighted head interconnected to the central handle in proximity to the first end of the central handle, the first weighted head including a first weighted end handle, a first weighted side handle, and a second weighted side handle; and a second weighted head of approximately equal shape and weight to the first weighted head, the second weighted head interconnected to the central handle in proximity to the second end of the central handle, the second weighted head including a second weighted end handle, a third weighted side handle, and a fourth weighted side handle.

2. The multi-grip dumbbell of claim 1 wherein the first weighted head and the second weighted head are each disc-shaped.

3. The multi-grip dumbbell of claim 2 wherein the first weighted end handle and the second weighted end handle each have two oppositely-positioned arc-shaped ends.

4. The multi-grip dumbbell of claim 3 wherein the first weighted side handle, the second weighted side handle, the third weighted side handle, and the fourth weighted side handle are each arc-shaped.

5. The multi-grip dumbbell of claim 4 wherein the first weighted side handle and the second weighted side handle are in proximity to opposite sides of the first weighted head.

6. The multi-grip dumbbell of claim 5 wherein the first weighted side handle, the second weighted side handle, and the two arc-shaped ends of the first weighted end handle collectively create the disc shape of the first weighted head.

7. The multi-grip dumbbell of claim 4 wherein the third weighted side handle and the fourth weighted side handle are in proximity to opposite sides of the second weighted head.

8. The multi-grip dumbbell of claim 7 wherein the third weighted side handle, the fourth weighted side handle, and the two arc-shaped ends of the second weighted end handle collectively create the disc shape of the second weighted head.

9. The multi-grip dumbbell of claim 1 wherein the first weighted head and the second weighted head are each substantially planar.

10. The multi-grip dumbbell of claim 1 wherein the first weighted side handle, the second weighted side handle, the third weighted side handle, and the fourth weighted side handle each have a circumference that is one or more of round;
oval-shaped; and
U-shaped.

11. The multi-grip dumbbell of claim 1 wherein the central handle is one or more of
knurled; and
tapered.

12. The multi-grip dumbbell of claim 1 wherein one or more of the weighted side handles are one or more of
knurled; and
tapered.

13. The multi-grip dumbbell of claim 1 wherein the central handle is attached to the first weighted head and to the second weighted head by one or more of
pressing a portion of the first end of the central handle into a recess in proximity to the center of an inner surface of the first weighted head and a portion of the second end into a recess in proximity to the center of an inner surface of the second weighted head;
welding the first end of the central handle in proximity to the center of an inner surface of the first weighted head and the second end in proximity to the center of an inner surface of the second weighted head;
screwing the first end of the central handle in proximity to the center of an inner surface of the first weighted head and the second end in proximity to the center of an inner surface of the second weighted head; and
bolting the first end of the central handle in proximity to the center of an inner surface of the first weighted head and the second end in proximity to the center of an inner surface of the second weighted head.

14. The multi-grip dumbbell of claim 1 wherein the first weighted side handle, the second weighted side handle, and the first weighted end handle arc a unitary structure.

15. The multi-grip dumbbell of claim 1 wherein the first weighted side handle and the second weighted side handle are attached to the first weighted end handle by one or more of
pressing a portion of the first weighted side handle into a first recess in the first weighted end handle and pressing a portion of the second weighted side handle into a second recess in the first weighted end handle;
welding the first weighted side handle and the second weighted side handle to the first weighted end handle;
bolting the first weighted side handle and the second weighted side handle to the first weighted end handle; and
using epoxy to affix the first weighted side handle and the second weighted side handle to the first weighted end handle.

16. The multi-grip dumbbell of claim 1 wherein the third weighted side handle, the fourth weighted side handle, and the second weighted end handle are a unitary structure.

17. The multi-grip dumbbell of claim 1 wherein the third weighted side handle and the fourth weighted side handle are attached to the second weighted end handle by one or more of
pressing a portion of the third weighted side handle into a first recess in the second weighted end handle and pressing a portion of the fourth weighted side handle into a second recess in the second weighted end handle;
welding the third weighted side handle and the fourth weighted side handle to the second weighted end handle;
bolting the third weighted side handle and the fourth weighted side handle to the second weighted end handle; and
using epoxy to affix the third weighted side handle and the fourth weighted side handle to the second weighted end handle.

18. The multi-grip dumbbell of claim 1 wherein the first weighted end handle and the second weighted end handle are coated with one or more of
rubber;
polyurethane;
plastic;
chrome plating;
non-chip paint; and
neoprene.

19. The multi-grip dumbbell of claim 1 wherein the multi-grip dumbbell is fabricated from one or of
steel;
cast iron;
urethane;
plastic;
foam;
chrome; and
one or more of gold, silver, platinum, and titanium.

* * * * *